US007688295B2

(12) United States Patent
Hsu et al.

(10) Patent No.: US 7,688,295 B2
(45) Date of Patent: Mar. 30, 2010

(54) DRIVE SYSTEM AND METHOD FOR A COLOR DISPLAY

(75) Inventors: Ying-Hao Hsu, Tainan (TW); Ming-Chia Shih, Tainan (TW)

(73) Assignee: Chi Mei Optoelectronics Corp. (TW)

( * ) Notice: Subject to any disclaimer, the term of this patent is extended or adjusted under 35 U.S.C. 154(b) by 1041 days.

(21) Appl. No.: 11/388,842

(22) Filed: Mar. 24, 2006

(65) Prior Publication Data

US 2006/0221029 A1 Oct. 5, 2006

(30) Foreign Application Priority Data

Mar. 29, 2005 (TW) ..... 94109765 A

(51) Int. Cl.
*G09G 3/36* (2006.01)
*G09G 5/10* (2006.01)

(52) U.S. Cl. ..... 345/88; 345/690

(58) Field of Classification Search ..... 345/55–100, 345/204–214, 690–697
See application file for complete search history.

(56) References Cited

U.S. PATENT DOCUMENTS

| | | | | |
|---|---|---|---|---|
| 5,717,474 | A | 2/1998 | Sarma | |
| 5,847,688 | A | 12/1998 | Ohi et al. | |
| 6,611,246 | B1 * | 8/2003 | Ito et al. | 345/94 |
| 2002/0149598 | A1 | 10/2002 | Greier et al. | |
| 2004/0246216 | A1 * | 12/2004 | Hosaka | 345/87 |
| 2005/0225545 | A1 * | 10/2005 | Takatori et al. | 345/204 |

* cited by examiner

*Primary Examiner*—David L Lewis
(74) *Attorney, Agent, or Firm*—Trop Pruner & Hu, P.C.

(57) ABSTRACT

A display has plural pixel groups each having plural color pixels. In a given frame that is divided into a first sub-period and a second sub-period, a first signal is provided in the first sub-period to a pixel of a given color in a first pixel group, and a second signal is provided to the pixel in the second sub-period. The first signal is set to one of a first polarity and a second polarity, and the second signal is set to one of the first polarity and second polarity, wherein the first signal and the second signal form a first sequence. A pixel of the given color in a second pixel group that is adjacent the first pixel group is driven with a second sequence of signals that is the same as the first sequence.

32 Claims, 21 Drawing Sheets

Red Light

Green Light

Blue Light

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | L | L | H |
| | | R21 | G21 | B21 | R22 | G22 | B22 | − | + | − | + | − | + | L | L | H | H | H | L |
| | | R31 | G31 | B31 | R32 | G32 | B32 | + | − | + | − | + | − | H | H | L | L | L | H |
| | | R41 | G41 | B41 | R42 | G42 | B42 | − | + | − | + | − | + | L | L | H | H | H | L |
| | | R51 | G51 | B51 | R52 | G52 | B52 | + | − | + | − | + | − | H | H | L | L | L | H |
| | | R61 | G61 | B61 | R62 | G62 | B62 | − | + | − | + | − | + | L | L | H | H | H | L |
| | sub-frame 2 | R11 | G11 | B11 | R12 | G12 | B12 | − | + | − | + | − | + | L | L | H | H | H | L |
| | | R21 | G21 | B21 | R22 | G22 | B22 | + | − | + | − | + | − | H | H | L | L | L | H |
| | | R31 | G31 | B31 | R32 | G32 | B32 | − | + | − | + | − | + | L | L | H | H | H | L |
| | | R41 | G41 | B41 | R42 | G42 | B42 | + | − | + | − | + | − | H | H | L | L | L | H |
| | | R51 | G51 | B51 | R52 | G52 | B52 | − | + | − | + | − | + | L | L | H | H | H | L |
| | | R61 | G61 | B61 | R62 | G62 | B62 | + | − | + | − | + | − | H | H | L | L | L | H |
| frame N+1 | sub-frame 1 | R11 | G11 | B11 | R12 | G12 | B12 | + | − | + | − | + | − | H | H | L | L | L | H |
| | | R21 | G21 | B21 | R22 | G22 | B22 | − | + | − | + | − | + | L | L | H | H | H | L |
| | | R31 | G31 | B31 | R32 | G32 | B32 | + | − | + | − | + | − | H | H | L | L | L | H |
| | | R41 | G41 | B41 | R42 | G42 | B42 | − | + | − | + | − | + | L | L | H | H | H | L |
| | | R51 | G51 | B51 | R52 | G52 | B52 | + | − | + | − | + | − | H | H | L | L | L | H |
| | | R61 | G61 | B61 | R62 | G62 | B62 | − | + | − | + | − | + | L | L | H | H | H | L |
| | sub-frame 2 | R11 | G11 | B11 | R12 | G12 | B12 | − | + | − | + | − | + | L | L | H | H | H | L |
| | | R21 | G21 | B21 | R22 | G22 | B22 | + | − | + | − | + | − | H | H | L | L | L | H |
| | | R31 | G31 | B31 | R32 | G32 | B32 | − | + | − | + | − | + | L | L | H | H | H | L |
| | | R41 | G41 | B41 | R42 | G42 | B42 | + | − | + | − | + | − | H | H | L | L | L | H |
| | | R51 | G51 | B51 | R52 | G52 | B52 | − | + | − | + | − | + | L | L | H | H | H | L |
| | | R61 | G61 | B61 | R62 | G62 | B62 | + | − | + | − | + | − | H | H | L | L | L | H |

Table 1: driving embodiment 1

Fig. 5

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | L | H | L | H | L |
| | | R21 | G21 | B21 | R22 | G22 | B22 | − | + | − | + | − | + | H | L | H | L | H | L |
| | | R31 | G31 | B31 | R32 | G32 | B32 | + | − | + | − | + | − | L | H | L | H | L | H |
| | | R41 | G41 | B41 | R42 | G42 | B42 | − | + | − | + | − | + | L | H | L | H | L | H |
| | | R51 | G51 | B51 | R52 | G52 | B52 | + | − | + | − | + | − | H | L | H | L | H | L |
| | | R61 | G61 | B61 | R62 | G62 | B62 | − | + | − | + | − | + | H | L | H | L | H | L |
| | sub-frame 2 | R11 | G11 | B11 | R12 | G12 | B12 | − | + | − | + | − | + | L | H | L | H | L | H |
| | | R21 | G21 | B21 | R22 | G22 | B22 | + | − | + | − | + | − | L | H | L | H | L | H |
| | | R31 | G31 | B31 | R32 | G32 | B32 | − | + | − | + | − | + | H | L | H | L | H | L |
| | | R41 | G41 | B41 | R42 | G42 | B42 | + | − | + | − | + | − | H | L | H | L | H | L |
| | | R51 | G51 | B51 | R52 | G52 | B52 | − | + | − | + | − | + | L | H | L | H | L | H |
| | | R61 | G61 | B61 | R62 | G62 | B62 | + | − | + | − | + | − | L | H | L | H | L | H |
| frame N+1 | sub-frame 1 | R11 | G11 | B11 | R12 | G12 | B12 | + | − | + | − | + | − | H | L | H | L | H | L |
| | | R21 | G21 | B21 | R22 | G22 | B22 | − | + | − | + | − | + | H | L | H | L | H | L |
| | | R31 | G31 | B31 | R32 | G32 | B32 | + | − | + | − | + | − | L | H | L | H | L | H |
| | | R41 | G41 | B41 | R42 | G42 | B42 | − | + | − | + | − | + | L | H | L | H | L | H |
| | | R51 | G51 | B51 | R52 | G52 | B52 | + | − | + | − | + | − | H | L | H | L | H | L |
| | | R61 | G61 | B61 | R62 | G62 | B62 | − | + | − | + | − | + | H | L | H | L | H | L |
| | sub-frame 2 | R11 | G11 | B11 | R12 | G12 | B12 | − | + | − | + | − | + | L | H | L | H | L | H |
| | | R21 | G21 | B21 | R22 | G22 | B22 | + | − | + | − | + | − | L | H | L | H | L | H |
| | | R31 | G31 | B31 | R32 | G32 | B32 | − | + | − | + | − | + | H | L | H | L | H | L |
| | | R41 | G41 | B41 | R42 | G42 | B42 | + | − | + | − | + | − | H | L | H | L | H | L |
| | | R51 | G51 | B51 | R52 | G52 | B52 | − | + | − | + | − | + | L | H | L | H | L | H |
| | | R61 | G61 | B61 | R62 | G62 | B62 | + | − | + | − | + | − | L | H | L | H | L | H |

Table 2: driving embodiment 2

Fig. 6

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | H | H | H | H |
| | | R21 | G21 | B21 | R22 | G22 | B22 | − | + | − | + | − | + | H | H | H | H | H | H |
| | | R31 | G31 | B31 | R32 | G32 | B32 | + | − | + | − | + | − | H | H | H | H | H | H |
| | | R41 | G41 | B41 | R42 | G42 | B42 | − | + | − | + | − | + | H | H | H | H | H | H |
| | | R51 | G51 | B51 | R52 | G52 | B52 | + | − | + | − | + | − | H | H | H | H | H | H |
| | | R61 | G61 | B61 | R62 | G62 | B62 | − | + | − | + | − | + | H | H | H | H | H | H |
| | sub-frame 2 | R11 | G11 | B11 | R12 | G12 | B12 | + | − | + | − | + | − | L | L | L | L | L | L |
| | | R21 | G21 | B21 | R22 | G22 | B22 | − | + | − | + | − | + | L | L | L | L | L | L |
| | | R31 | G31 | B31 | R32 | G32 | B32 | + | − | + | − | + | − | L | L | L | L | L | L |
| | | R41 | G41 | B41 | R42 | G42 | B42 | − | + | − | + | − | + | L | L | L | L | L | L |
| | | R51 | G51 | B51 | R52 | G52 | B52 | + | − | + | − | + | − | L | L | L | L | L | L |
| | | R61 | G61 | B61 | R62 | G62 | B62 | − | + | − | + | − | + | L | L | L | L | L | L |
| frame N+1 | sub-frame 1 | R11 | G11 | B11 | R12 | G12 | B12 | − | + | − | + | − | + | H | H | H | H | H | H |
| | | R21 | G21 | B21 | R22 | G22 | B22 | + | − | + | − | + | − | H | H | H | H | H | H |
| | | R31 | G31 | B31 | R32 | G32 | B32 | − | + | − | + | − | + | H | H | H | H | H | H |
| | | R41 | G41 | B41 | R42 | G42 | B42 | + | − | + | − | + | − | H | H | H | H | H | H |
| | | R51 | G51 | B51 | R52 | G52 | B52 | − | + | − | + | − | + | H | H | H | H | H | H |
| | | R61 | G61 | B61 | R62 | G62 | B62 | + | − | + | − | + | − | H | H | H | H | H | H |
| | sub-frame 2 | R11 | G11 | B11 | R12 | G12 | B12 | − | + | − | + | − | + | L | L | L | L | L | L |
| | | R21 | G21 | B21 | R22 | G22 | B22 | + | − | + | − | + | − | L | L | L | L | L | L |
| | | R31 | G31 | B31 | R32 | G32 | B32 | − | + | − | + | − | + | L | L | L | L | L | L |
| | | R41 | G41 | B41 | R42 | G42 | B42 | + | − | + | − | + | − | L | L | L | L | L | L |
| | | R51 | G51 | B51 | R52 | G52 | B52 | − | + | − | + | − | + | L | L | L | L | L | L |
| | | R61 | G61 | B61 | R62 | G62 | B62 | + | − | + | − | + | − | L | L | L | L | L | L |

Table 3 :driving embodiment 3

Fig. 7

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | L | H | H |
| | | R21 | G21 | B21 | R22 | G22 | B22 | − | + | − | + | − | + | L | L | H | H | L | L |
| | | R31 | G31 | B31 | R32 | G32 | B32 | + | − | + | − | + | − | H | H | L | L | H | H |
| | | R41 | G41 | B41 | R42 | G42 | B42 | − | + | − | + | − | + | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | − | + | − | + | − | + | L | L | H | H | L | L |
| | sub-frame 2 | R11 | G11 | B11 | R12 | G12 | B12 | + | − | + | − | + | − | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | + | − | + | − | + | − | L | L | H | H | L | L |
| | | R41 | G41 | B41 | R42 | G42 | B42 | − | + | − | + | − | + | H | H | L | L | H | H |
| | | R51 | G51 | B51 | R52 | G52 | B52 | + | − | + | − | + | − | L | L | H | H | L | L |
| | | R61 | G61 | B61 | R62 | G62 | B62 | − | + | − | + | − | + | H | H | L | L | H | H |
| frame N+1 | sub-frame 1 | R11 | G11 | B11 | R12 | G12 | B12 | − | + | − | + | − | + | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | − | + | − | + | − | + | H | H | L | L | H | H |
| | | R41 | G41 | B41 | R42 | G42 | B42 | + | − | + | − | + | − | L | L | H | H | L | L |
| | | R51 | G51 | B51 | R52 | G52 | B52 | − | + | − | + | − | + | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | + | − | + | − | + | − | H | H | L | L | H | H |
| | | R31 | G31 | B31 | R32 | G32 | B32 | − | + | − | + | − | + | L | L | H | H | L | L |
| | | R41 | G41 | B41 | R42 | G42 | B42 | + | − | + | − | + | − | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | + | − | + | − | + | − | H | H | L | L | H | H |

Table 4: driving embodiment 4

Fig. 8

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | L | H | L | H | L |
| | | R21 | G21 | B21 | R22 | G22 | B22 | − | + | − | + | − | + | H | L | H | L | H | L |
| | | R31 | G31 | B31 | R32 | G32 | B32 | + | − | + | − | + | − | L | H | L | H | L | H |
| | | R41 | G41 | B41 | R42 | G42 | B42 | − | + | − | + | − | + | L | H | L | H | L | H |
| | | R51 | G51 | B51 | R52 | G52 | B52 | + | − | + | − | + | − | H | L | H | L | H | L |
| | | R61 | G61 | B61 | R62 | G62 | B62 | − | + | − | + | − | + | H | L | H | L | H | L |
| | sub-frame 2 | R11 | G11 | B11 | R12 | G12 | B12 | + | − | + | − | + | − | L | H | L | H | L | H |
| | | R21 | G21 | B21 | R22 | G22 | B22 | − | + | − | + | − | + | L | H | L | H | L | H |
| | | R31 | G31 | B31 | R32 | G32 | B32 | + | − | + | − | + | − | H | L | H | L | H | L |
| | | R41 | G41 | B41 | R42 | G42 | B42 | − | + | − | + | − | + | H | L | H | L | H | L |
| | | R51 | G51 | B51 | R52 | G52 | B52 | + | − | + | − | + | − | L | H | L | H | L | H |
| | | R61 | G61 | B61 | R62 | G62 | B62 | − | + | − | + | − | + | L | H | L | H | L | H |
| frame N+1 | sub-frame 1 | R11 | G11 | B11 | R12 | G12 | B12 | − | + | − | + | − | + | H | L | H | L | H | L |
| | | R21 | G21 | B21 | R22 | G22 | B22 | + | − | + | − | + | − | H | L | H | L | H | L |
| | | R31 | G31 | B31 | R32 | G32 | B32 | − | + | − | + | − | + | L | H | L | H | L | H |
| | | R41 | G41 | B41 | R42 | G42 | B42 | + | − | + | − | + | − | L | H | L | H | L | H |
| | | R51 | G51 | B51 | R52 | G52 | B52 | − | + | − | + | − | + | H | L | H | L | H | L |
| | | R61 | G61 | B61 | R62 | G62 | B62 | + | − | + | − | + | − | H | L | H | L | H | L |
| | sub-frame 2 | R11 | G11 | B11 | R12 | G12 | B12 | − | + | − | + | − | + | L | H | L | H | L | H |
| | | R21 | G21 | B21 | R22 | G22 | B22 | + | − | + | − | + | − | L | H | L | H | L | H |
| | | R31 | G31 | B31 | R32 | G32 | B32 | − | + | − | + | − | + | H | L | H | L | H | L |
| | | R41 | G41 | B41 | R42 | G42 | B42 | + | − | + | − | + | − | H | L | H | L | H | L |
| | | R51 | G51 | B51 | R52 | G52 | B52 | − | + | − | + | − | + | L | H | L | H | L | H |
| | | R61 | G61 | B61 | R62 | G62 | B62 | + | − | + | − | + | − | L | H | L | H | L | H |

Table 5: driving embodiment 5

Fig. 9

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | + | − | + | − | + | − | H | H | L | L | H | H |
| | | R41 | G41 | B41 | R42 | G42 | B42 | + | − | + | − | + | − | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | − | + | − | + | − | + | L | L | H | H | L | L |
| | | R41 | G41 | B41 | R42 | G42 | B42 | − | + | − | + | − | + | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | − | + | − | + | − | + | H | H | L | L | H | H |
| frame N+1 | sub-frame 1 | R11 | G11 | B11 | R12 | G12 | B12 | + | − | + | − | + | − | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | + | − | + | − | + | − | H | H | L | L | H | H |
| | | R41 | G41 | B41 | R42 | G42 | B42 | + | − | + | − | + | − | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | − | + | − | + | − | + | L | L | H | H | L | L |
| | | R41 | G41 | B41 | R42 | G42 | B42 | − | + | − | + | − | + | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | − | + | − | + | − | + | H | H | L | L | H | H |

Table 6: driving embodiment 6

Fig. 10

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | L | H | L | H | L |
| | | R21 | G21 | B21 | R22 | G22 | B22 | + | − | + | − | + | − | H | L | H | L | H | L |
| | | R31 | G31 | B31 | R32 | G32 | B32 | + | − | + | − | + | − | L | H | L | H | L | H |
| | | R41 | G41 | B41 | R42 | G42 | B42 | + | − | + | − | + | − | L | H | L | H | L | H |
| | | R51 | G51 | B51 | R52 | G52 | B52 | + | − | + | − | + | − | H | L | H | L | H | L |
| | | R61 | G61 | B61 | R62 | G62 | B62 | + | − | + | − | + | − | H | L | H | L | H | L |
| | sub-frame 2 | R11 | G11 | B11 | R12 | G12 | B12 | − | + | − | + | − | + | L | H | L | H | L | H |
| | | R21 | G21 | B21 | R22 | G22 | B22 | − | + | − | + | − | + | L | H | L | H | L | H |
| | | R31 | G31 | B31 | R32 | G32 | B32 | − | + | − | + | − | + | H | L | H | L | H | L |
| | | R41 | G41 | B41 | R42 | G42 | B42 | − | + | − | + | − | + | H | L | H | L | H | L |
| | | R51 | G51 | B51 | R52 | G52 | B52 | − | + | − | + | − | + | L | H | L | H | L | H |
| | | R61 | G61 | B61 | R62 | G62 | B62 | − | + | − | + | − | + | L | H | L | H | L | H |
| frame N+1 | sub-frame 1 | R11 | G11 | B11 | R12 | G12 | B12 | + | − | + | − | + | − | H | L | H | L | H | L |
| | | R21 | G21 | B21 | R22 | G22 | B22 | + | − | + | − | + | − | H | L | H | L | H | L |
| | | R31 | G31 | B31 | R32 | G32 | B32 | + | − | + | − | + | − | L | H | L | H | L | H |
| | | R41 | G41 | B41 | R42 | G42 | B42 | + | − | + | − | + | − | L | H | L | H | L | H |
| | | R51 | G51 | B51 | R52 | G52 | B52 | + | − | + | − | + | − | H | L | H | L | H | L |
| | | R61 | G61 | B61 | R62 | G62 | B62 | + | − | + | − | + | − | H | L | H | L | H | L |
| | sub-frame 2 | R11 | G11 | B11 | R12 | G12 | B12 | − | + | − | + | − | + | L | H | L | H | L | H |
| | | R21 | G21 | B21 | R22 | G22 | B22 | − | + | − | + | − | + | L | H | L | H | L | H |
| | | R31 | G31 | B31 | R32 | G32 | B32 | − | + | − | + | − | + | H | L | H | L | H | L |
| | | R41 | G41 | B41 | R42 | G42 | B42 | − | + | − | + | − | + | H | L | H | L | H | L |
| | | R51 | G51 | B51 | R52 | G52 | B52 | − | + | − | + | − | + | L | H | L | H | L | H |
| | | R61 | G61 | B61 | R62 | G62 | B62 | − | + | − | + | − | + | L | H | L | H | L | H |

Table 7:driving embodiment 7

Fig. 11

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | H | H | H | H |
| | | R21 | G21 | B21 | R22 | G22 | B22 | + | − | + | − | + | − | H | H | H | H | H | H |
| | | R31 | G31 | B31 | R32 | G32 | B32 | + | − | + | − | + | − | H | H | H | H | H | H |
| | | R41 | G41 | B41 | R42 | G42 | B42 | + | − | + | − | + | − | H | H | H | H | H | H |
| | | R51 | G51 | B51 | R52 | G52 | B52 | + | − | + | − | + | − | H | H | H | H | H | H |
| | | R61 | G61 | B61 | R62 | G62 | B62 | + | − | + | − | + | − | H | H | H | H | H | H |
| | sub-frame 2 | R11 | G11 | B11 | R12 | G12 | B12 | + | − | + | − | + | − | L | L | L | L | L | L |
| | | R21 | G21 | B21 | R22 | G22 | B22 | + | − | + | − | + | − | L | L | L | L | L | L |
| | | R31 | G31 | B31 | R32 | G32 | B32 | + | − | + | − | + | − | L | L | L | L | L | L |
| | | R41 | G41 | B41 | R42 | G42 | B42 | + | − | + | − | + | − | L | L | L | L | L | L |
| | | R51 | G51 | B51 | R52 | G52 | B52 | + | − | + | − | + | − | L | L | L | L | L | L |
| | | R61 | G61 | B61 | R62 | G62 | B62 | + | − | + | − | + | − | L | L | L | L | L | L |
| frame N+1 | sub-frame 1 | R11 | G11 | B11 | R12 | G12 | B12 | − | + | − | + | − | + | H | H | H | H | H | H |
| | | R21 | G21 | B21 | R22 | G22 | B22 | − | + | − | + | − | + | H | H | H | H | H | H |
| | | R31 | G31 | B31 | R32 | G32 | B32 | − | + | − | + | − | + | H | H | H | H | H | H |
| | | R41 | G41 | B41 | R42 | G42 | B42 | − | + | − | + | − | + | H | H | H | H | H | H |
| | | R51 | G51 | B51 | R52 | G52 | B52 | − | + | − | + | − | + | H | H | H | H | H | H |
| | | R61 | G61 | B61 | R62 | G62 | B62 | − | + | − | + | − | + | H | H | H | H | H | H |
| | sub-frame 2 | R11 | G11 | B11 | R12 | G12 | B12 | − | + | − | + | − | + | L | L | L | L | L | L |
| | | R21 | G21 | B21 | R22 | G22 | B22 | − | + | − | + | − | + | L | L | L | L | L | L |
| | | R31 | G31 | B31 | R32 | G32 | B32 | − | + | − | + | − | + | L | L | L | L | L | L |
| | | R41 | G41 | B41 | R42 | G42 | B42 | − | + | − | + | − | + | L | L | L | L | L | L |
| | | R51 | G51 | B51 | R52 | G52 | B52 | − | + | − | + | − | + | L | L | L | L | L | L |
| | | R61 | G61 | B61 | R62 | G62 | B62 | − | + | − | + | − | + | L | L | L | L | L | L |

Table 8: driving embodiment 8

Fig. 12

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | + | − | + | − | + | − | H | H | L | L | H | H |
| | | R41 | G41 | B41 | R42 | G42 | B42 | + | − | + | − | + | − | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | + | − | + | − | + | − | L | L | H | H | L | L |
| | | R21 | G21 | B21 | R22 | G22 | B22 | + | − | + | − | + | − | H | H | L | L | H | H |
| | | R31 | G31 | B31 | R32 | G32 | B32 | + | − | + | − | + | − | L | L | H | H | L | L |
| | | R41 | G41 | B41 | R42 | G42 | B42 | + | − | + | − | + | − | H | H | L | L | H | H |
| | | R51 | G51 | B51 | R52 | G52 | B52 | + | − | + | − | + | − | L | L | H | H | L | L |
| | | R61 | G61 | B61 | R62 | G62 | B62 | + | − | + | − | + | − | H | H | L | L | H | H |
| frame N+1 | sub-frame 1 | R11 | G11 | B11 | R12 | G12 | B12 | − | + | − | + | − | + | H | H | L | L | H | H |
| | | R21 | G21 | B21 | R22 | G22 | B22 | − | + | − | + | − | + | L | L | H | H | L | L |
| | | R31 | G31 | B31 | R32 | G32 | B32 | − | + | − | + | − | + | H | H | L | L | H | H |
| | | R41 | G41 | B41 | R42 | G42 | B42 | − | + | − | + | − | + | L | L | H | H | L | L |
| | | R51 | G51 | B51 | R52 | G52 | B52 | − | + | − | + | − | + | H | H | L | L | H | H |
| | | R61 | G61 | B61 | R62 | G62 | B62 | − | + | − | + | − | + | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | − | + | − | + | − | + | L | L | H | H | L | L |
| | | R41 | G41 | B41 | R42 | G42 | B42 | − | + | − | + | − | + | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | − | + | − | + | − | + | H | H | L | L | H | H |

Table 9: driving embodiment 9

Fig. 13

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | − | + | − | + | − | + | H | H | L | L | H | H |
| | | R41 | G41 | B41 | R42 | G42 | B42 | − | + | − | + | − | + | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | + | − | + | − | + | − | L | L | H | H | L | L |
| | | R41 | G41 | B41 | R42 | G42 | B42 | + | − | + | − | + | − | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | − | + | − | + | − | + | H | H | L | L | H | H |
| frame N+1 | sub-frame 1 | R11 | G11 | B11 | R12 | G12 | B12 | + | − | + | − | + | − | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | − | + | − | + | − | + | H | H | L | L | H | H |
| | | R41 | G41 | B41 | R42 | G42 | B42 | − | + | − | + | − | + | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | + | − | + | − | + | − | L | L | H | H | L | L |
| | | R41 | G41 | B41 | R42 | G42 | B42 | + | − | + | − | + | − | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | − | + | − | + | − | + | H | H | L | L | H | H |

Table 10: driving embodiment 10

Fig. 14

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | H | H | H | H |
| | | R21 | G21 | B21 | R22 | G22 | B22 | + | − | + | − | + | − | H | H | H | H | H | H |
| | | R31 | G31 | B31 | R32 | G32 | B32 | − | + | − | + | − | + | H | H | H | H | H | H |
| | | R41 | G41 | B41 | R42 | G42 | B42 | − | + | − | + | − | + | H | H | H | H | H | H |
| | | R51 | G51 | B51 | R52 | G52 | B52 | + | − | + | − | + | − | H | H | H | H | H | H |
| | | R61 | G61 | B61 | R62 | G62 | B62 | + | − | + | − | + | − | H | H | H | H | H | H |
| | sub-frame 2 | R11 | G11 | B11 | R12 | G12 | B12 | + | − | + | − | + | − | L | L | L | L | L | L |
| | | R21 | G21 | B21 | R22 | G22 | B22 | + | − | + | − | + | − | L | L | L | L | L | L |
| | | R31 | G31 | B31 | R32 | G32 | B32 | − | + | − | + | − | + | L | L | L | L | L | L |
| | | R41 | G41 | B41 | R42 | G42 | B42 | − | + | − | + | − | + | L | L | L | L | L | L |
| | | R51 | G51 | B51 | R52 | G52 | B52 | + | − | + | − | + | − | L | L | L | L | L | L |
| | | R61 | G61 | B61 | R62 | G62 | B62 | + | − | + | − | + | − | L | L | L | L | L | L |
| frame N+1 | sub-frame 1 | R11 | G11 | B11 | R12 | G12 | B12 | − | + | − | + | − | + | H | H | H | H | H | H |
| | | R21 | G21 | B21 | R22 | G22 | B22 | − | + | − | + | − | + | H | H | H | H | H | H |
| | | R31 | G31 | B31 | R32 | G32 | B32 | + | − | + | − | + | − | H | H | H | H | H | H |
| | | R41 | G41 | B41 | R42 | G42 | B42 | + | − | + | − | + | − | H | H | H | H | H | H |
| | | R51 | G51 | B51 | R52 | G52 | B52 | − | + | − | + | − | + | H | H | H | H | H | H |
| | | R61 | G61 | B61 | R62 | G62 | B62 | − | + | − | + | − | + | H | H | H | H | H | H |
| | sub-frame 2 | R11 | G11 | B11 | R12 | G12 | B12 | − | + | − | + | − | + | L | L | L | L | L | L |
| | | R21 | G21 | B21 | R22 | G22 | B22 | − | + | − | + | − | + | L | L | L | L | L | L |
| | | R31 | G31 | B31 | R32 | G32 | B32 | + | − | + | − | + | − | L | L | L | L | L | L |
| | | R41 | G41 | B41 | R42 | G42 | B42 | + | − | + | − | + | − | L | L | L | L | L | L |
| | | R51 | G51 | B51 | R52 | G52 | B52 | − | + | − | + | − | + | L | L | L | L | L | L |
| | | R61 | G61 | B61 | R62 | G62 | B62 | − | + | − | + | − | + | L | L | L | L | L | L |

Table 11: driving embodiment 11

Fig. 15

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | − | + | − | + | − | + | H | H | L | L | H | H |
| | | R41 | G41 | B41 | R42 | G42 | B42 | − | + | − | + | − | + | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | + | − | + | − | + | − | L | L | H | H | L | L |
| | | R21 | G21 | B21 | R22 | G22 | B22 | + | − | + | − | + | − | H | H | L | L | H | H |
| | | R31 | G31 | B31 | R32 | G32 | B32 | − | + | − | + | − | + | L | L | H | H | L | L |
| | | R41 | G41 | B41 | R42 | G42 | B42 | − | + | − | + | − | + | H | H | L | L | H | H |
| | | R51 | G51 | B51 | R52 | G52 | B52 | + | − | + | − | + | − | L | L | H | H | L | L |
| | | R61 | G61 | B61 | R62 | G62 | B62 | + | − | + | − | + | − | H | H | L | L | H | H |
| frame N+1 | sub-frame 1 | R11 | G11 | B11 | R12 | G12 | B12 | − | + | − | + | − | + | H | H | L | L | H | H |
| | | R21 | G21 | B21 | R22 | G22 | B22 | − | + | − | + | − | + | L | L | H | H | L | L |
| | | R31 | G31 | B31 | R32 | G32 | B32 | + | − | + | − | + | − | H | H | L | L | H | H |
| | | R41 | G41 | B41 | R42 | G42 | B42 | + | − | + | − | + | − | L | L | H | H | L | L |
| | | R51 | G51 | B51 | R52 | G52 | B52 | − | + | − | + | − | + | H | H | L | L | H | H |
| | | R61 | G61 | B61 | R62 | G62 | B62 | − | + | − | + | − | + | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | + | − | + | − | + | − | L | L | H | H | L | L |
| | | R41 | G41 | B41 | R42 | G42 | B42 | + | − | + | − | + | − | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | − | + | − | + | − | + | H | H | L | L | H | H |

Table 12: driving embodiment 12

Fig. 16

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | L | H | H |
| | | R21 | G21 | B21 | R22 | G22 | B22 | + | − | + | − | + | − | L | L | H | H | L | L |
| | | R31 | G31 | B31 | R32 | G32 | B32 | + | − | + | − | + | − | H | H | L | L | H | H |
| | | R41 | G41 | B41 | R42 | G42 | B42 | + | − | + | − | + | − | L | L | H | H | L | L |
| | | R51 | G51 | B51 | R52 | G52 | B52 | + | − | + | − | + | − | H | H | L | L | H | H |
| | | R61 | G61 | B61 | R62 | G62 | B62 | + | − | + | − | + | − | L | L | H | H | L | L |
| | sub-frame 2 | R11 | G11 | B11 | R12 | G12 | B12 | + | − | + | − | + | − | L | L | H | H | L | L |
| | | R21 | G21 | B21 | R22 | G22 | B22 | − | + | − | + | − | + | H | H | L | L | H | H |
| | | R31 | G31 | B31 | R32 | G32 | B32 | + | − | + | − | + | − | L | L | H | H | L | L |
| | | R41 | G41 | B41 | R42 | G42 | B42 | − | + | − | + | − | + | H | H | L | L | H | H |
| | | R51 | G51 | B51 | R52 | G52 | B52 | + | − | + | − | + | − | L | L | H | H | L | L |
| | | R61 | G61 | B61 | R62 | G62 | B62 | − | + | − | + | − | + | H | H | L | L | H | H |
| frame N+1 | sub-frame 1 | R11 | G11 | B11 | R12 | G12 | B12 | − | + | − | + | − | + | H | H | L | L | H | H |
| | | R21 | G21 | B21 | R22 | G22 | B22 | − | + | − | + | − | + | L | L | H | H | L | L |
| | | R31 | G31 | B31 | R32 | G32 | B32 | − | + | − | + | − | + | H | H | L | L | H | H |
| | | R41 | G41 | B41 | R42 | G42 | B42 | − | + | − | + | − | + | L | L | H | H | L | L |
| | | R51 | G51 | B51 | R52 | G52 | B52 | − | + | − | + | − | + | H | H | L | L | H | H |
| | | R61 | G61 | B61 | R62 | G62 | B62 | − | + | − | + | − | + | L | L | H | H | L | L |
| | sub-frame 2 | R11 | G11 | B11 | R12 | G12 | B12 | − | + | − | + | − | + | L | L | H | H | L | L |
| | | R21 | G21 | B21 | R22 | G22 | B22 | + | − | + | − | + | − | H | H | L | L | H | H |
| | | R31 | G31 | B31 | R32 | G32 | B32 | − | + | − | + | − | + | L | L | H | H | L | L |
| | | R41 | G41 | B41 | R42 | G42 | B42 | + | − | + | − | + | − | H | H | L | L | H | H |
| | | R51 | G51 | B51 | R52 | G52 | B52 | − | + | − | + | − | + | L | L | H | H | L | L |
| | | R61 | G61 | B61 | R62 | G62 | B62 | + | − | + | − | + | − | H | H | L | L | H | H |

Table 13: driving embodiment 13

Fig. 17

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | H | H | L |
| | | R21 | G21 | B21 | R22 | G22 | B22 | + | − | + | − | + | − | L | L | H | L | L | H |
| | | R31 | G31 | B31 | R32 | G32 | B32 | + | − | + | − | + | − | H | H | L | H | H | L |
| | | R41 | G41 | B41 | R42 | G42 | B42 | + | − | + | − | + | − | L | L | H | L | L | H |
| | | R51 | G51 | B51 | R52 | G52 | B52 | + | − | + | − | + | − | H | H | L | H | H | L |
| | | R61 | G61 | B61 | R62 | G62 | B62 | + | − | + | − | + | − | L | L | H | L | L | H |
| | sub-frame 2 | R11 | G11 | B11 | R12 | G12 | B12 | + | − | + | − | + | − | L | L | H | L | L | H |
| | | R21 | G21 | B21 | R22 | G22 | B22 | − | + | − | + | − | + | H | H | L | H | H | L |
| | | R31 | G31 | B31 | R32 | G32 | B32 | + | − | + | − | + | − | L | L | H | L | L | H |
| | | R41 | G41 | B41 | R42 | G42 | B42 | − | + | − | + | − | + | H | H | L | H | H | L |
| | | R51 | G51 | B51 | R52 | G52 | B52 | + | − | + | − | + | − | L | L | H | L | L | H |
| | | R61 | G61 | B61 | R62 | G62 | B62 | − | + | − | + | − | + | H | H | L | H | H | L |
| frame N+1 | sub-frame 1 | R11 | G11 | B11 | R12 | G12 | B12 | − | + | − | + | − | + | H | H | L | H | H | L |
| | | R21 | G21 | B21 | R22 | G22 | B22 | − | + | − | + | − | + | L | L | H | L | L | H |
| | | R31 | G31 | B31 | R32 | G32 | B32 | − | + | − | + | − | + | H | H | L | H | H | L |
| | | R41 | G41 | B41 | R42 | G42 | B42 | − | + | − | + | − | + | L | L | H | L | L | H |
| | | R51 | G51 | B51 | R52 | G52 | B52 | − | + | − | + | − | + | H | H | L | H | H | L |
| | | R61 | G61 | B61 | R62 | G62 | B62 | − | + | − | + | − | + | L | L | H | L | L | H |
| | sub-frame 2 | R11 | G11 | B11 | R12 | G12 | B12 | − | + | − | + | − | + | L | L | H | L | L | H |
| | | R21 | G21 | B21 | R22 | G22 | B22 | + | − | + | − | + | − | H | H | L | H | H | L |
| | | R31 | G31 | B31 | R32 | G32 | B32 | − | + | − | + | − | + | L | L | H | L | L | H |
| | | R41 | G41 | B41 | R42 | G42 | B42 | + | − | + | − | + | − | H | H | L | H | H | L |
| | | R51 | G51 | B51 | R52 | G52 | B52 | − | + | − | + | − | + | L | L | H | L | L | H |
| | | R61 | G61 | B61 | R62 | G62 | B62 | + | − | + | − | + | − | H | H | L | H | H | L |

Table 14: driving embodiment 14

Fig. 18

| | | arrangement of pixel group | | | | | | arrangement of voltage polarity | | | | | | arrangement of display signal | | | | | |
|---|---|---|---|---|---|---|---|---|---|---|---|---|---|---|---|---|---|---|---|
| frame N | sub-frame 1 | R11 | G11 | B11 | R12 | G12 | B12 | + | − | + | − | + | − | H | H | L | H | H | L |
| | | R21 | G21 | B21 | R22 | G22 | B22 | − | + | − | + | − | + | L | L | H | L | L | H |
| | | R31 | G31 | B31 | R32 | G32 | B32 | − | + | − | + | − | + | H | H | L | H | H | L |
| | | R41 | G41 | B41 | R42 | G42 | B42 | + | − | + | − | + | − | L | L | H | L | L | H |
| | | R51 | G51 | B51 | R52 | G52 | B52 | + | − | + | − | + | − | H | H | L | H | H | L |
| | | R61 | G61 | B61 | R62 | G62 | B62 | − | + | − | + | − | + | L | L | H | L | L | H |
| | sub-frame 2 | R11 | G11 | B11 | R12 | G12 | B12 | + | − | + | − | + | − | L | L | H | L | L | H |
| | | R21 | G21 | B21 | R22 | G22 | B22 | + | − | + | − | + | − | H | H | L | H | H | L |
| | | R31 | G31 | B31 | R32 | G32 | B32 | − | + | − | + | − | + | L | L | H | L | L | H |
| | | R41 | G41 | B41 | R42 | G42 | B42 | − | + | − | + | − | + | H | H | L | H | H | L |
| | | R51 | G51 | B51 | R52 | G52 | B52 | + | − | + | − | + | − | L | L | H | L | L | H |
| | | R61 | G61 | B61 | R62 | G62 | B62 | + | − | + | − | + | − | H | H | L | H | H | L |
| frame N+1 | sub-frame 1 | R11 | G11 | B11 | R12 | G12 | B12 | − | + | − | + | − | + | H | H | L | H | H | L |
| | | R21 | G21 | B21 | R22 | G22 | B22 | + | − | + | − | + | − | L | L | H | L | L | H |
| | | R31 | G31 | B31 | R32 | G32 | B32 | + | − | + | − | + | − | H | H | L | H | H | L |
| | | R41 | G41 | B41 | R42 | G42 | B42 | − | + | − | + | − | + | L | L | H | L | L | H |
| | | R51 | G51 | B51 | R52 | G52 | B52 | − | + | − | + | − | + | H | H | L | H | H | L |
| | | R61 | G61 | B61 | R62 | G62 | B62 | + | − | + | − | + | − | L | L | H | L | L | H |
| | sub-frame 2 | R11 | G11 | B11 | R12 | G12 | B12 | − | + | − | + | − | + | L | L | H | L | L | H |
| | | R21 | G21 | B21 | R22 | G22 | B22 | − | + | − | + | − | + | H | H | L | H | H | L |
| | | R31 | G31 | B31 | R32 | G32 | B32 | + | − | + | − | + | − | L | L | H | L | L | H |
| | | R41 | G41 | B41 | R42 | G42 | B42 | + | − | + | − | + | − | H | H | L | H | H | L |
| | | R51 | G51 | B51 | R52 | G52 | B52 | − | + | − | + | − | + | L | L | H | L | L | H |
| | | R61 | G61 | B61 | R62 | G62 | B62 | − | + | − | + | − | + | H | H | L | H | H | L |

Table 15: driving embodiment 15

Fig. 19

DRIVE SYSTEM AND METHOD FOR A COLOR DISPLAY

CROSS REFERENCE TO RELATED APPLICATIONIELD

This claims priority under 35 U.S.C. § 119 of Taiwan patent application No. 94109765, filed Mar. 29, 2005.

TECHNICAL FIELD

This invention relates to color displays, and more specifically, to a drive system and method for color displays.

BACKGROUND

In general, the light transmittance of a display such as a liquid crystal display (LCD) is different depending upon whether the viewer is looking at the picture (displayed image) squarely (directly) in front of the LCD or at an angle. This is because the incident light from different angles results in different retardation in the liquid crystal layer. Hence, the refractive index influence in the transmitted light will change according to different viewing angles and result in different transmittance when viewing from different angles. Consequently, an image displayed by the LCD may appear to have different brightnesses when viewed from different angles.

When various color pixels of the LCD (e.g., red pixel, green pixel, and blue pixel) having different brightnesses are mixed and viewed at different angles, color shift may occur, which means that the colors of a displayed image may look different at different angles.

BRIEF DESCRIPTION OF THE DRAWINGS

FIGS. 5-19 illustrate tables that depict various different driving sequences according to some embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
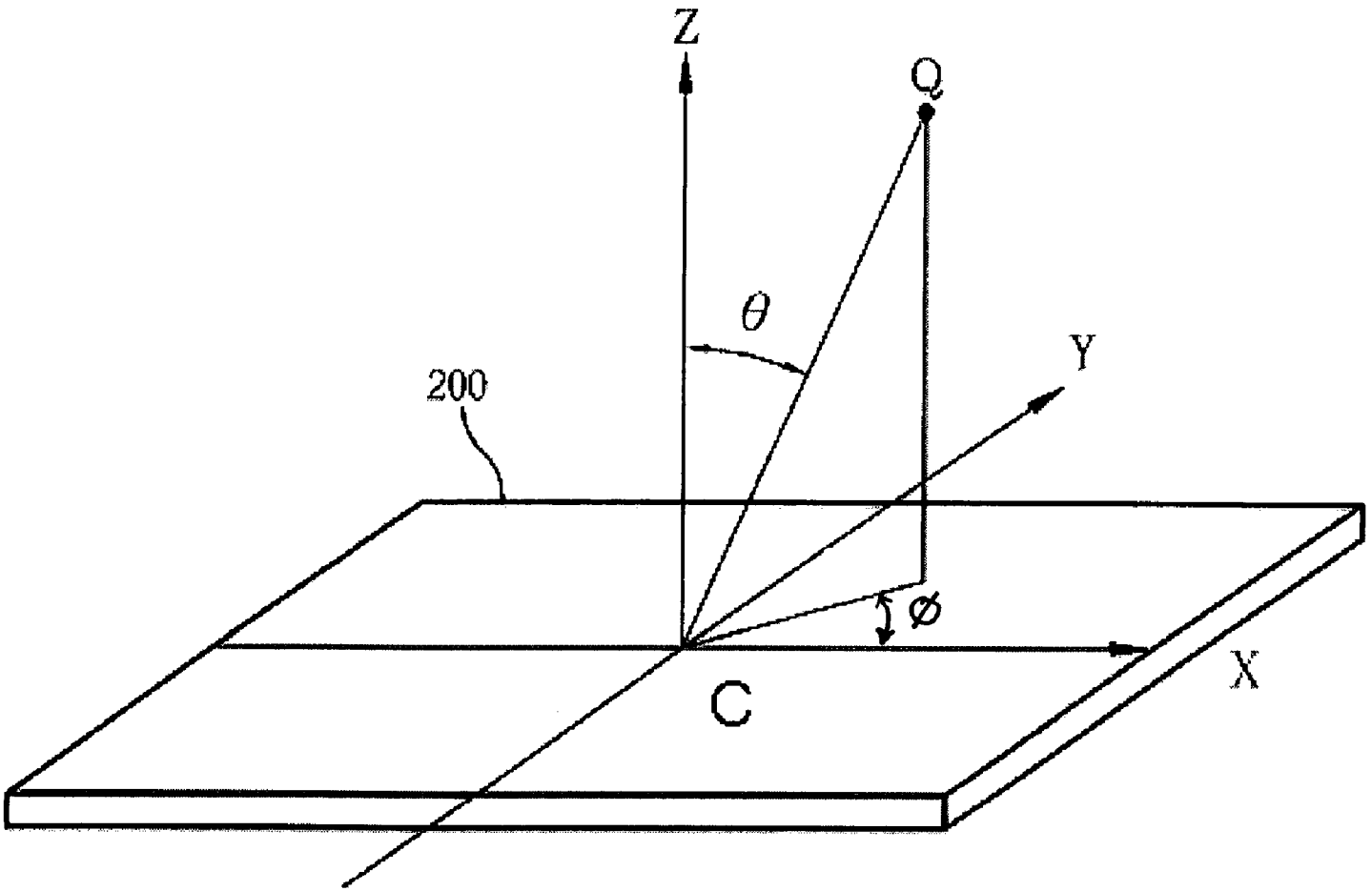
FIG. 1 is a schematic drawing of the relative position of a user at point Q looking at an LCD (liquid crystal display).
Figure 2A:
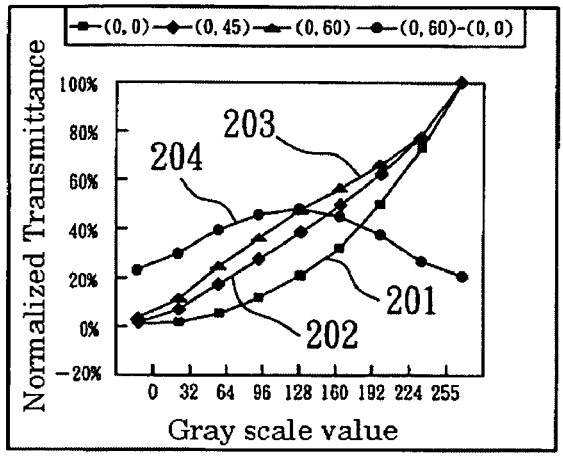
FIGS. 2*a* to 2*c* are curves showing the correlation between gray level value and the normalized light transmittance of red light, green light, and blue light at different viewing angles.
Figure 2B:
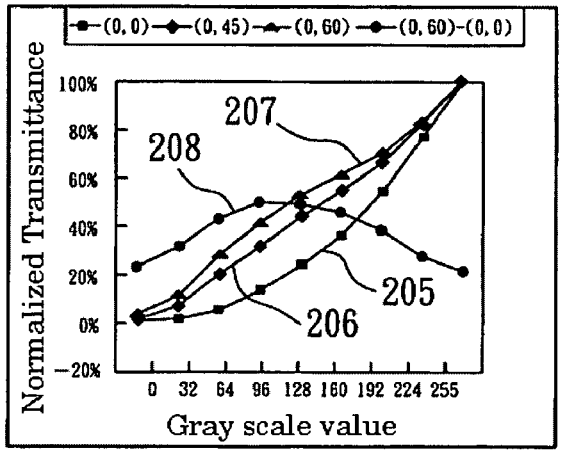
Figure 2C:
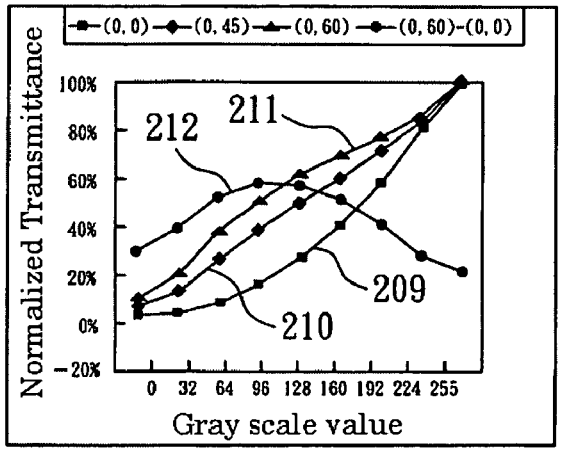

In a color display device, such as a liquid crystal display (LCD), each of the three primary colors—e.g., red, green, and blue—produces different color shift at different gray levels. FIG. 1 represents the relative position of a user when viewing an LCD 200 at point Q, and FIGS. 2*a* to 2*c* show the correlative curves of the gray scale values for red, green, and blue light, respectively, with respect to the normalized light transmittance for several different viewing angles. As an example, assume each pixel of the LCD has a gray level value between 0 and 255. The normalized light transmittance of any gray level value at a front view angle (viewer directly in front of the LCD) is the front view light transmittance, which corresponds to this gray level value, divided by the maximum front view light transmittance (for example, gray level 255 of a normally black type LCD). The normalized light transmittance of any gray level value from a side view angle (viewer at a slanted angle with respect to the LCD) is the side view light transmittance, which corresponds to this gray level value, divided by the side view light transmittance of the maximum gray level value (for example, gray level value 255).

As shown in FIG. 1, assuming that the angle between the line connecting the observation point Q to the center point (C) of LCD 200 and the Z axis (normal vector) of LCD 200 is θ degrees, and the angle between the line connecting the projection of point Q on display panel 200 and the center point (C) of LCD 200 and the X axis is ø degrees, then each of FIGS. 2*a* to 2*c* represents the correlative curves of the gray level value and the normalized light transmittance with angles (ø, θ) at (0, 0), (0, 45), and (0, 60). Also shown is the difference between the normalized light transmittance at angle (0, 60) and angle (0, 0). In FIG. 2*a*, curves 201, 202, and 203 correspond to respective angles (0, 0), (0, 45), and (0, 60). Curve 204 corresponds to the difference between the light transmittance at angles (0, 60) and (0, 0). When angles (ø, θ) equal (0, 0), the viewer is looking at the LCD 200 squarely from the front, and when angles (ø, θ) equal (0, 45) or (0, 60), the viewer is looking at the LCD 200 from the side—at an angle of 45 or 60 degrees, respectively.

Similarly, in FIG. 2*b*, curve 205 shows the correlative relationship of the gray level value to the normalized light transmittance when angle (ø, θ) is (0, 0). Curve 206 shows the relationship of gray level value to the normalized light transmittance when (ø, θ) is (0, 45). Curve 207 shows the relationship of the gray level value to the normalized light transmittance when (ø, θ) is (0, 60). Curve 208 represents the difference between the normalized light transmittances at angle (0, 60) and angle (0, 0).

In FIG. 2*c*, curves 209, 210, and 211 correspond to viewing angles (0, 0), (0, 45), and (0, 60), respectively, while curve 212 corresponds to the difference between light transmittance at angles (0, 60) and (0, 0).

As shown in FIGS. 2*a* to 2*c*, each individual color pixel having the same gray level value can have varying normalized light transmittances according to if the viewer's viewing angle, which results in color shift. However, when the gray level value is close to 0 or 255, the normalized light transmittance difference between front view and side view angles is small (close to 0%). To take advantage of this behavior, instead of driving a pixel to a specific target gray scale value using one pixel signal, two pixel signals can be used instead, one corresponding to a bright state gray level value (that usually has a higher value than the target gray scale value) and one corresponding to a dark state gray scale value (that usually has a lower gray scale value than the target gray scale value). The bright state gray scale value and dark state gray scale value are combined (when viewed by a user) to achieve the target gray scale value. In one example, if the target or original gray level value of the blue pixel is 128, a dark state display signal (corresponding to a dark state gray level value) 0 and a bright state display signal (corresponding to a bright state gray level value) 190 can be selected as a set of calibration gray level values (including the above-mentioned dark state gray level value and bright state gray level value). The target or original gray level value is obtained through combination of the dark state gray scale level value and bright state gray scale level value. The normalized light transmittance difference of the calibration gray level value set at the side view and front view angles is smaller than the normalized light transmittance difference of the original gray level value 128 at the side view and front view angles, but the same brightness of the original gray level can be obtained when looking at the LCD squarely from the front. Thus, the LCD's color shift at side view and front view angles is reduced by using the calibration gray level values.

Figure 3A:
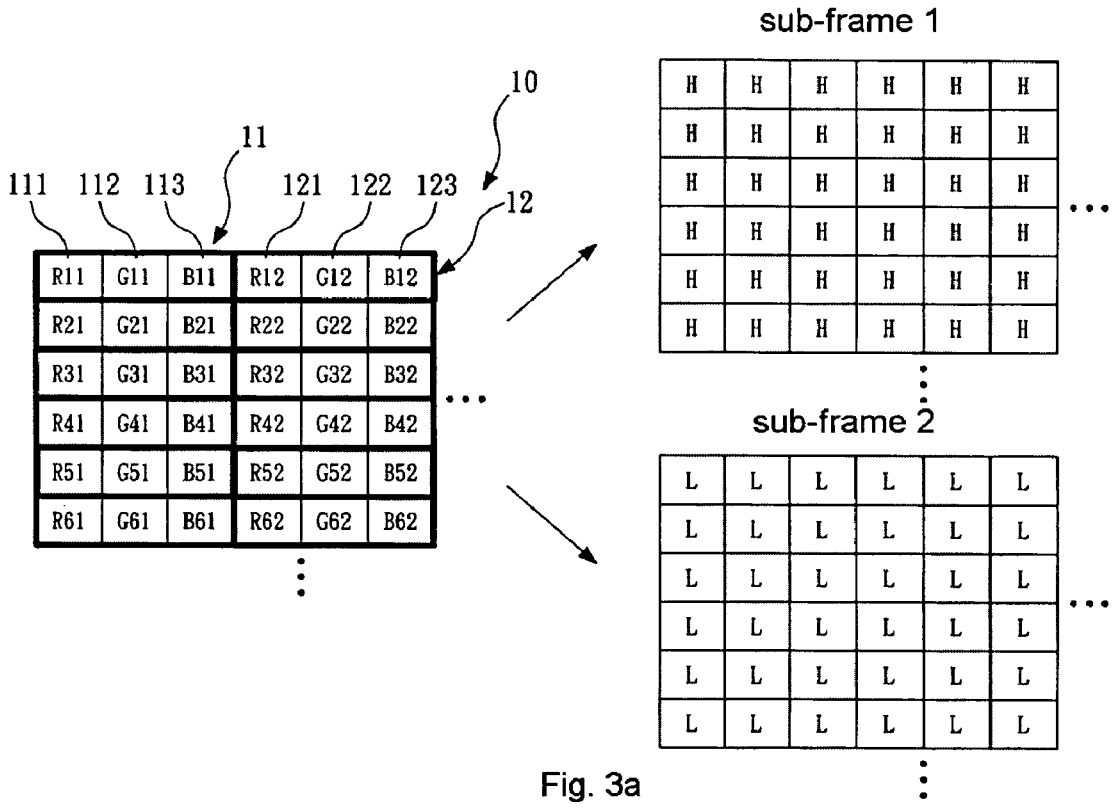
Fig. 3a (Prior Art)
FIG. 3*a* illustrates dark state and bright state display signals for various pixels, according to a conventional driving technique.

As shown in FIG. 3*a*, a color display device 10 (for example an LCD) includes a plurality of pixel groups 11, 12, 13, etc., which are arranged in a matrix. Each pixel group includes one red pixel, one green pixel and one blue pixel. The first pixel group 11 includes a red pixel 111, a green pixel 112, and a blue pixel 113. Similarly, the second pixel group 12 includes a red pixel 121, a green pixel 122, and a blue pixel 123.

Usually, in a color display, one picture is displayed during one frame time (or frame period). A "frame" represents a complete image or image of a series of images. A "frame period" contains an active period and a blanking period, where the active period is the time period to drive all pixels of an LCD panel, and the blanking period is used to match the period for blanking performed in CRT (cathode ray tube) monitors. The frame time is divided into two sub-frame times (or sub-scan periods). The color display displays an image according to signals driven in sub-frame 1 during the first sub-frame period, and displays an image according to signals driven in sub-frame 2 during the second sub-frame period. As shown in FIG. 3*a*, according to a conventional driving technique, in sub-frame 1, all color pixels of the image are driven by bright state display signals (H in FIG. 3*a*) to provide less color shift due to different viewing angles. In sub-frame 2, all color pixels of the picture are driven by dark state display signals (L in FIG. 3*a*) to also provide less color shift due to different viewing angles.

Figure 3B:
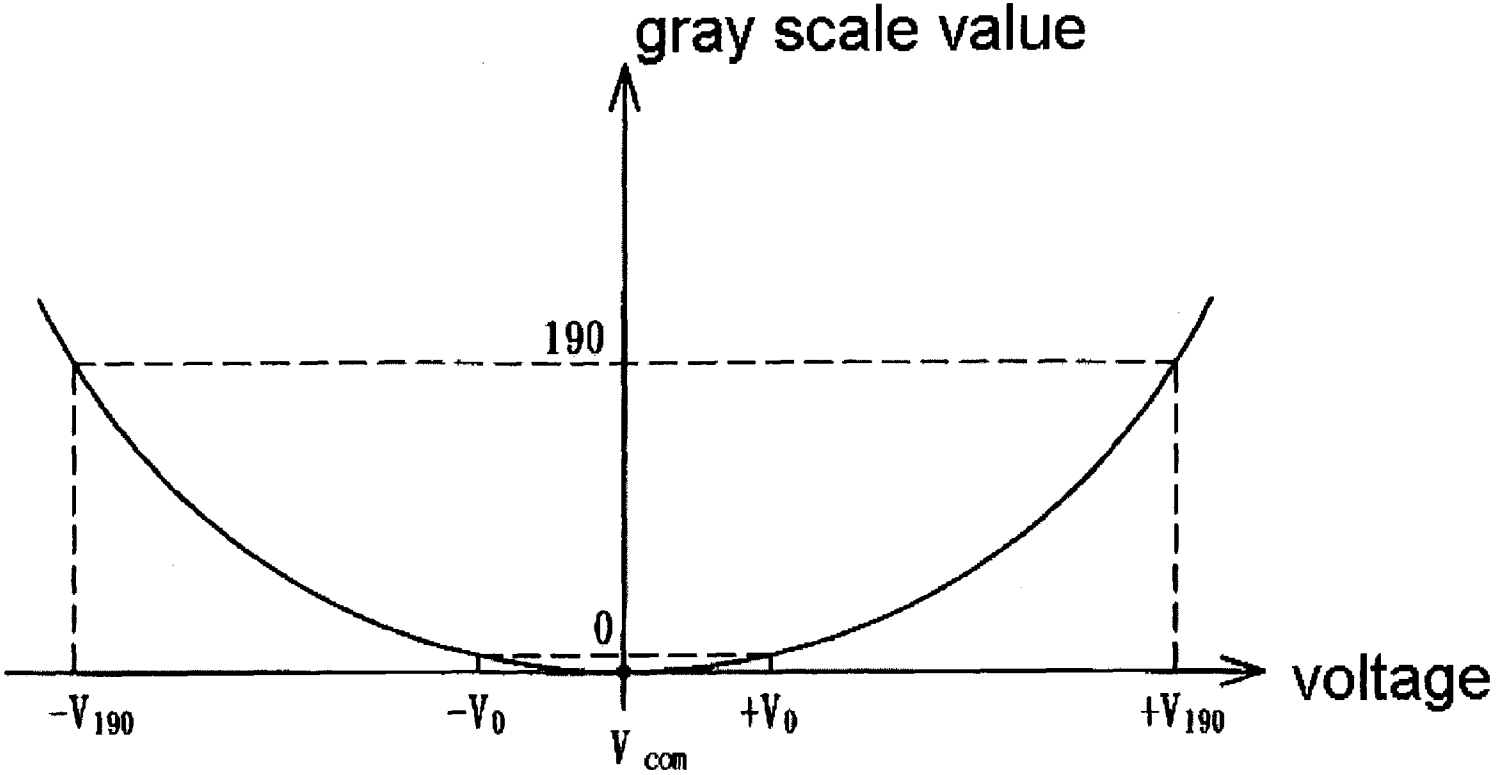
FIG. 3*b* schematically illustrates a relationship between driving voltage and the display gray scale value.

As further shown in FIG. 3*b* regarding the above example, if the original gray scale value of the blue pixel is 128, its dark state display signal (dark state gray scale value) is 0 and the bright state display signal (bright state gray scale value) is 190. Using these two values as a set of calibrating gray scale values, the original gray scale value 128 is obtained through combination.

Figure 3C:
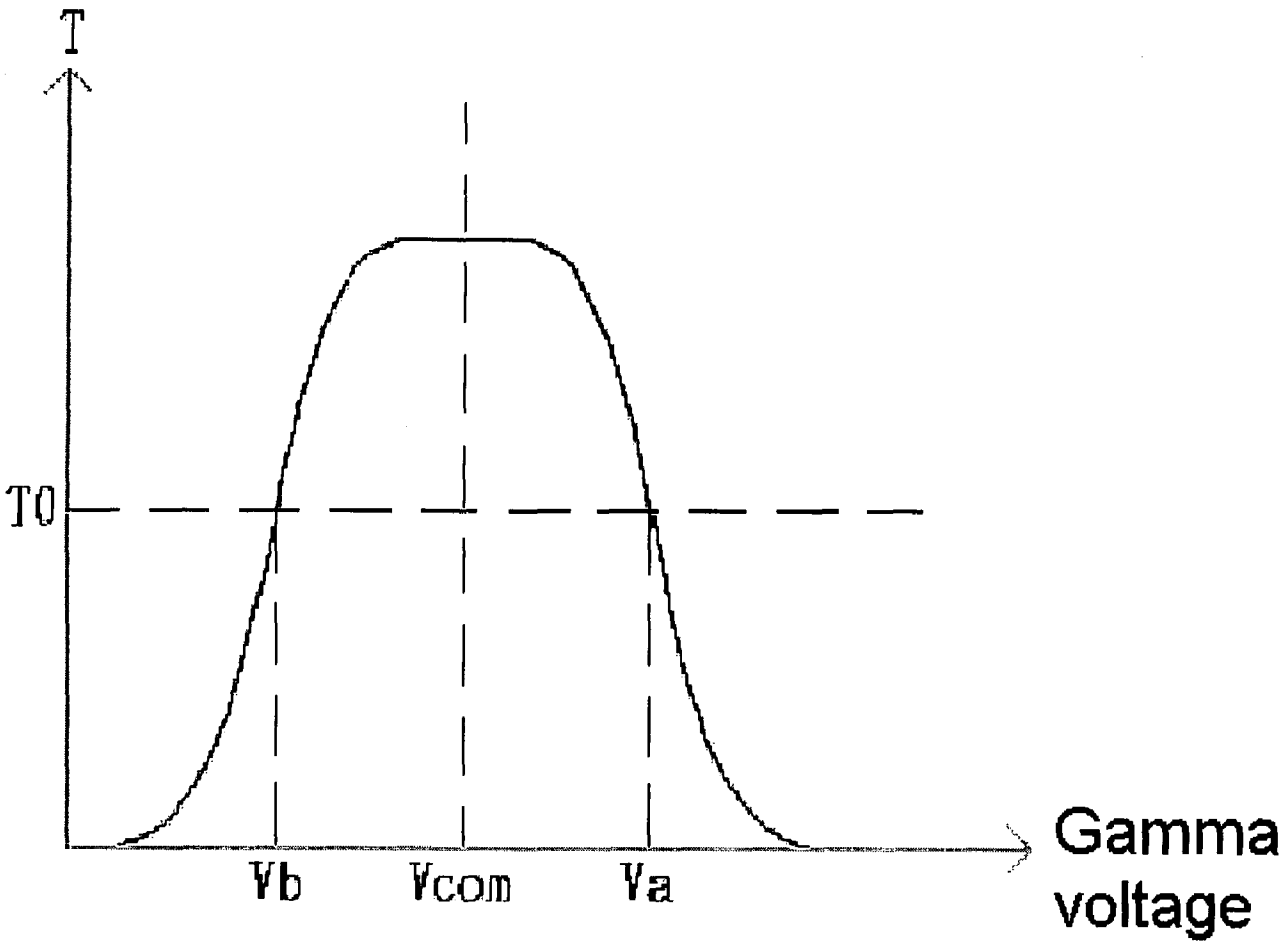
FIG. 3*c* illustrates a relationship between the voltage across the upper and lower substrates of a liquid crystal panel and the light transmittance of liquid crystal molecules in the liquid crystal display.

FIG. 3*c* illustrates the relationship between the voltage across the upper and lower substrates of a liquid crystal panel and the light transmittance of the liquid crystal molecules. In FIG. 3*c*, the X axis represents the voltage of the lower substrate of the liquid crystal panel when the voltage of the upper substrate is Vcom, and the Y axis represents the light transmittance T of the liquid crystal molecules. The driving circuit of the LCD changes the light transmittance of the liquid crystal molecules of the pixels in the liquid crystal panel by changing the voltage across the upper and lower substrates of each pixel so that the pixel produces different brightnesses. When the voltage of the upper substrate of the liquid crystal panel is Vcom, the difference between the voltage of the lower substrate and Vcom represents the voltage across the liquid crystal panel. The relationship between the voltage between the upper and lower substrates of the liquid crystal panel and the light transmittance of the liquid crystal molecules between the two substrates is not a linear one, but a Gamma curve as shown in FIG. 3*c*. Therefore, when the voltage at the upper substrate is fixed at Vcom, the voltage at the lower substrate is called a Gamma voltage.

The light transmittance of liquid crystals is associated with the voltage between the two sides of the liquid crystals but generally is not affected by the polarity of the voltage supplied to the two sides of the liquid crystals. The relationship between the voltage across the upper and lower substrates of the liquid crystal panel and the light transmittance of the liquid crystals is a Gamma curve which is generally symmetric with respect to Vcom in the center. Therefore, in response to two Gamma voltages of the same amplitude but different polarities—for example Gamma voltage Va with positive polarity and Gamma voltage Vb with negative polarity, the light transmittance T0 of the liquid crystals of the pixel is generally identical. In other words, assuming there are two pixels which have the same voltage Vcom at the upper substrate but different voltages (Va and Vb) at the lower substrate, the two pixels will generally exhibit the same brightness although they have different voltages at the lower substrate.

If each pixel is continuously supplied with voltage of the same polarity, the liquid crystal molecules of the pixel will be damaged. Therefore, the liquid crystal molecules can be protected by alternating the polarity of the voltage across the two substrates. In other words, when a pixel needs to continuously show a consistent brightness, this can be achieved by controlling the lower substrate of the pixel by alternately changing the polarity of the voltage across the upper and lower substrates. In this way, the liquid crystal molecules of the pixel will not be damaged due to continuously displaying consistent brightness.

In relation to the common voltage polarity signal level (Vcom), the bright state display signal (e.g., bright state gray scale value 190) has a positive Gamma voltage polarity ($+V_{190}$) and a negative Gamma voltage polarity ($-V_{190}$) to show the bright state display signal; and the dark state display signal (e.g., dark state gray scale value 0) has a positive Gamma voltage polarity ($+V_0$) and a negative Gamma voltage polarity ($-V_0$) to show the dark state display signal.

Take red pixel 111 of the first pixel group 11 and the red pixel 121 of the second pixel group 12 shown in FIG. 3*a* as an example. The conventional driving sequences for these two red pixels are different in terms of the voltages applied to the pixels and the polarity of the voltages. While the driving sequence for the red pixel 111 of the first pixel group 11 is +V190, −V0, +V190 and −V0, for example, and the driving sequence for the red pixel 121 of the second pixel 12 adjacent to the first picture 11 is $-V_{190}$, $+V_0$, $-V_{190}$, and +V0. However, due to lack of uniformity of the LCD panel, TFTs driving the pixels of the LCD panel will have different voltage-gray scale relationships. As a result, assuming all pixels share the same common voltage polarity signal level (Vcom), the brightness displayed by color pixels will not be completely identical even if they receive the same input signal. Therefore, when the driving sequence of the same color pixel in an adjacent pixel group is different (sequence of $+V_{190}$, $-V_0$, $+V_{190}$, $-V_0$ versus $-V_{190}$, $+V_0$, $-V_{190}$, $+V_0$), flickering or degradation of the resolution may occur due to potential difference in relation to the common voltage polarity signal level (Vcom).

To reduce flickering or degraded resolution of the displayed image, a driver system according to some embodiments for a color display device enables the sequences of pixel signals for adjacent pixels of the same color to be identical. A "sequence" of display signals (or more simply "signals") refers to a time sequence of signals each corresponding to a bright state or dark state gray scale value and each having a positive or negative polarity. Each pixel is driven by two signals in respective sub-scan periods (or "sub-periods") of a frame, wherein a dark state display signal is driven in one sub-scan period and a bright state display signal is driven in the other sub-scan period. The dark state display signal and bright state display signal are "combined" (based on viewing or perception by a user) to achieve the original gray scale value. In other words, although the pixel actually displays the dark state and bright state gray scale values corresponding to respective dark state and bright state display signals in two successive sub-scan periods of a frame, the user perceives the original gray scale value based on the user perceiving the combined dark state and bright state gray scale values. A sequence of signals for driving a pixel can include signals in two sub-scan periods, or alternatively, signals in four sub-scan periods.

Figure 4:
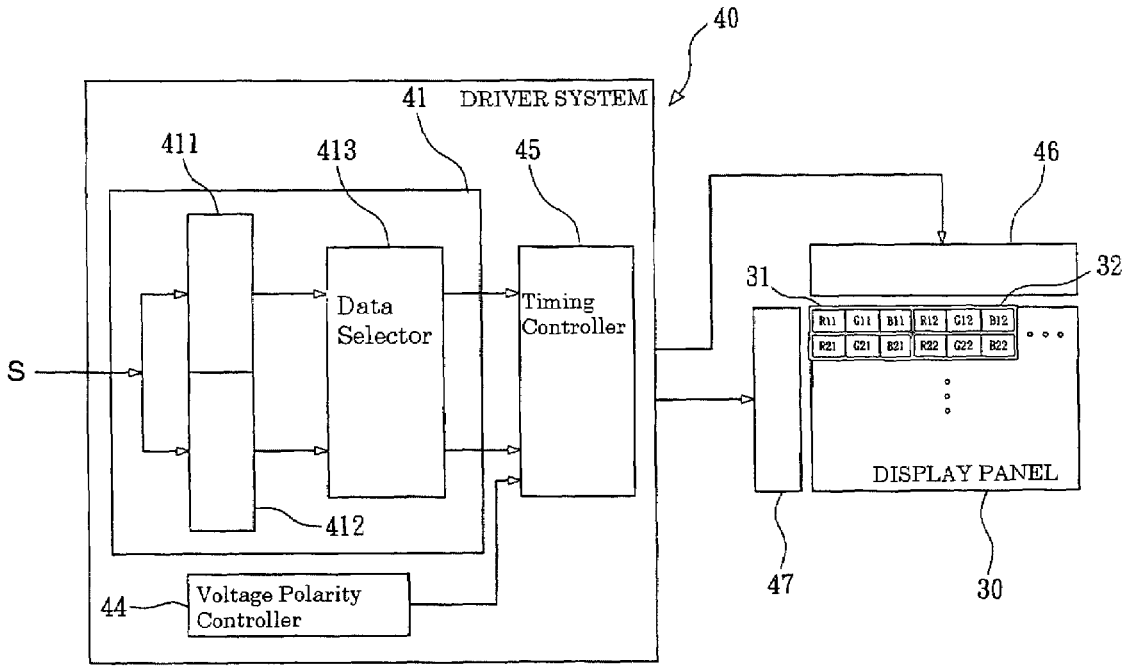
FIG. 4 is a block diagram of a display device having a driver system for a color display according to an embodiment.

FIG. 4 depicts an LCD device having a driver system 40 according to some embodiments for driving a color display panel 30. The color display panel 30 has a plurality of pixel groups 31, 32, and so forth. The pixel groups are arranged in a matrix, and each pixel group includes a first color pixel, a second color pixel, and a third color pixel. For example, each pixel group includes a red pixel, a green pixel, and a blue pixel. The pixel group 31 includes a red pixel R11, a green pixel G11, and a blue pixel B11. Similarly, the second pixel group 32 includes a red pixel R12, a green pixel G12, and a blue pixel B12.

The driver system 40 includes a display signal controller 41, a voltage polarity controller 44, and a timing controller 45. Although the controllers are depicted as separate blocks, it is contemplated that the controllers can be integrated in one device, or alternatively, the controllers can be implemented in plural devices. The display signal controller 41 includes a first lookup table 411, a second lookup table 412, and a data selector 413. After an original display signal is sent from the signal end (S) to be input into the first lookup table 411 and the second lookup table 412, the original display signal is converted into a first display signal (for example, a bright state display signal) and a second display signal (for example, a dark state display signal) by the first and second lookup tables 411 and 412, respectively. Then the data selector 413 selects one of the first display signal and the second display signal as a first input signal. The voltage polarity controller 44 receives the first input signal and sets the Gamma voltage polarity of the first input signal. The signal is sent by the timing controller 45 to the data driver 46 to drive a selected pixel group. The timing controller 45 also activates the scan driver 47 to enable the color display 30 to display the selected pixel group. Note that the arrangement of the display signal controller 41 and the Gamma voltage polarity controller 44 may be different in other embodiments. For example, display signal controller 41 and the Gamma voltage polarity controller 44 can be combined with the data driver 46.

The display signal controller 41 and voltage polarity controller 44 cooperate to provide sequences of signals to drive respective pixels, as described below for some embodiments.

A. Driving Sequence +H, −L, +H, −L

The following embodiments involve color pixels driven by the sequence +H, −L, +H, −L in two consecutive frames N, N+1, as discussed further below. Note that the sequence of display signals in frame N (+H, −L) is a repeat of the sequence of display signals in frame N+1.

As depicted in Table 1 of FIG. 5, the Gamma voltage polarity controller 44 is used to provide a plurality of Gamma voltage polarities in a plurality of scan periods (or frames), each scan period (or frame) being divided into a first sub-scan period and a second sub-scan period. Table 1 shows an arrangement of pixel groups (a sub-matrix of pixel groups that forms a subset of the overall matrix). A first pixel group includes a red pixel R11, a green pixel G11, and a blue pixel B11; a second pixel group includes a red pixel R12, green pixel G12, and blue pixel B12; and so forth.

The Gamma voltage polarity controller 44 provides a first sub-Gamma voltage polarity to be received by a color pixel of the pixel group in the first sub-scan period, and a second Gamma voltage polarity to be received by the color pixel of the pixel group in the second sub-scan time.

For example, in sub-frame 1 (first sub-scan period) of frame N (Nth scan period), the Gamma voltage polarity of the red pixel R11 of the first pixel group is positive (hereafter expressed as +), and in sub-frame 2 (second sub-scan period) of frame N, the Gamma voltage polarity of the red pixel R11 of the first pixel group is negative (hereafter expressed as −). In sub-frame 1 of frame N+1, the Gamma voltage polarity of the red pixel R11 of the first pixel group is positive (+), and in sub-frame 2 of frame N+1, the Gamma voltage polarity of red pixel R11 of the first pixel group is negative (−). The Gamma voltage polarity controller 44 is thus used to set a plurality of Gamma voltage polarities for the color pixels in a plurality of sub-scan periods.

The display signal controller 41 provides a plurality of first display signals in the first sub-scan period, to be received by the color pixels of the corresponding pixel group, and a plurality of second display signals in the second sub-scan period, to be received by the color pixels of the corresponding pixel group. A first display signal and a second display signal include the bright state display signal and the dark state display signal of a color pixel to be combined into a combined display signal (the desired original display signal). In other words, a first display signal received in the first sub-scan period is combined with a second display signal received in the second sub-scan period to derive the combined display signal. Note that the combination is based on user perception and not actually electrical combination by circuitry in the display device.

For example, in sub-frame 1 (first sub-scan period) of frame N (Nth scan period), the red pixel R11 of the first pixel group is a bright state display signal (hereafter expressed as H), and in sub-frame 2 (second sub-scan period) of frame N, the red pixel R11 of the first pixel group is a dark state display signal (hereafter expressed as L) which is combined with the bright state display signal (H) to form a combined display signal. In sub-frame 1 of frame N+1, the red pixel R11 of the first pixel group is a bright state display signal (H), and in sub-frame 2 of frame N+1, the red pixel R11 of the first pixel group is a dark state display signal (L) which is combined with the brighter state display signal (H) to form a combined display signal.

The Gamma voltage polarity controller 44 and the display signal controller 41 provide display signals at predetermined Gamma voltage polarities in a driving sequence so that color pixels receive the display signals at respective Gamma voltage polarities. For example, the driving sequence for the red pixel R11 in the first pixel group is as follows: the first sub-Gamma voltage polarity in the first sub-scan period is positive (+), and the first display signal in the first sub-scan period is the bright state display signal (H) of the red pixel R11; the second sub-Gamma voltage polarity in second sub-scan period is negative (−), and the second display signal in the second sub-scan period is the dark state display signal (L) of the red pixel R11. Therefore, in frames N and N+1, which include four sub-scan periods, the driving sequence for the red pixel R11 is +H, −L, +H and −L (corresponding to display signals and polarities in the following sequence of time periods: (1) frame N, first sub-scan period; (2) frame N, second sub-scan period; (3) frame N+1, first sub-scan period; and (4) frame N+1, second sub-scan period).

In accordance with some embodiments, the Gamma voltage polarity controller 44 and the display signal controller 41 collectively provide display signals at respective Gamma voltage polarities in the same driving sequence for the red pixel R12 of the second pixel group, which is adjacent to the first pixel group. The red pixel R12 receives the same sequence of display signals at respective Gamma voltage polarities, except with an offset of one sub-scan period. Thus, adjacent red pixels R11 and R12 are driven by the same sequences of display signals, which helps to reduce flickering effects.

The first sub-Gamma voltage polarity for the red pixel R12 of the second pixel group in the first sub-scan period is negative (−), and the first display signal in the first sub-scan period is the dark state display signal (L) of the red pixel R12; and the second sub-Gamma voltage polarity in the second sub-scan period is positive (+), and the second display signal of in the second sub-scan period is the bright state display signal (H) of the red pixel R12. The driving sequence for the red pixel R12 in the second pixel group is −L, +H, −L, +H.

As indicated above, the driving sequence for the red pixel R11 of the first pixel group is +H, −L, +H and −L, while the driving sequence for the red pixel R12 of the adjacent second pixel group is −L, +H, −L and +H. The driving sequences for R11 and R12 are the same but with an offset of one sub-scan period (one sub-scan period ahead or behind). The driving sequences for the other red pixels (such as R21 and R22) in adjacent pixel groups are also the same. The following illustrates sequences in multiple frames (e.g., frame N, N+1, N+2, N+3, etc.) for the four red pixels R11, R12, R21, and R22:

R11: <u>+H,−L,+H,−L</u>, +H, −L, +H, −L, . . .

R12: −L, <u>+H,−L,+H,−L</u>, +H, −L, +H, −L, . . .

R21: −L, <u>+H,−L,+H,−L</u>, +H, −L, +H, −L, . . .

R22: <u>+H,−L,+H,−L</u>, +H, −L, +H, −L, . . .

The underlined sequences above indicate that the sequences for the four red pixels are identical, except that the sequences for R12 and R21 are offset with respect to the sequences for R11 and R22 by one sub-scan period.

Table 2 of FIG. 6 depicts a second driving embodiment. In the second driving embodiment, the driving sequence for the red pixel R11 of the first pixel group is +H, −L, +H and −L, and the driving sequence for the red pixel R12 of the second pixel group is −L, +H, −L and +H. The driving sequences are the same but with an offset of one sub-scan period (one sub-scan period ahead or behind).

In the second driving embodiment, the driving sequence for the green pixel G11 of the first pixel group is: −L, +H, −L and +H, and the driving sequence for the green pixel G12 of the second pixel group is: +H, −L, +H and −L. The driving sequences for G11 and G12 are the same but with an offset of one sub-scan period (one sub-scan period ahead or behind).

In the second driving embodiment, the driving sequence for the blue pixel B11 of the first pixel group is: +H, −L, +H and −L, and the driving sequence for the blue pixel B12 of the second pixel group is: −L, +H, −L and +H. The driving sequences are the same but with an offset of one sub-scan period (one sub-scan period ahead or behind).

Table 6 of FIG. 10 shows another driving embodiment, in which the driving sequence for the red pixel R11 of the first pixel group is +H, −L, +H and −L, and the driving sequence for the red pixel R12 of the second pixel group is −L, +H, −L and +H. The driving sequences are the same but with an offset of one sub-scan period (one sub-scan period ahead or behind).

Table 7 of FIG. 11 shows a further driving embodiment in which the driving sequence for the red pixel R11 of the first pixel group is +H, −L, +H and −L, and the driving sequence for the red pixel R12 of the second pixel group is −L, +H, −L and +H. The driving sequences are the same but with an offset of one sub-scan period (one sub-scan period ahead or behind).

In the driving embodiment of Table 7, the driving sequence for the blue pixel B11 of the first pixel group is: +H, −L, +H and −L, and the driving sequence for the blue pixel B12 of the second pixel group is: −L, +H, −L and +H. The driving sequences are the same but with an offset of one sub-scan time.

Similarly, in the driving embodiment of Table 10 depicted in FIG. 14, the driving sequence for the red pixel R11 of the first pixel group is +H, −L, +H and −L, and the driving sequence for the red pixel R12 of the second pixel group is −L, +H, −L and +H. The driving sequences are the same but with an offset of one sub-scan period.

B. Driving Sequence −H, +L, −H and +L

The driving sequence −H, +L, −H, +L is based on the following sequence: the first sub-Gamma voltage polarity in the first sub-scan period is negative (−), and the first display signal in the first sub-scan period is the bright state display signal (H) of the corresponding color pixel; the second sub-Gamma voltage polarity in the second sub-scan period is positive (+), and the second display signal in the second sub-scan period is the dark state display signal (L) of the corresponding color pixel. Therefore the driving sequence is −H, +L, −H and +L in two consecutive frames N, N+1.

This driving sequence also repeats every frame—the sequence in frame N is the same as the sequence in frame N+1.

In the driving embodiment of Table 1 (FIG. 5), the driving sequence for the blue pixel B11 of the first pixel group is: +L, −H, +L and −H, and the driving sequence for the blue pixel B12 of the second pixel group is: −H, +L, −H and +L. The driving sequences are the same but with an offset of one sub-scan period (one sub-scan period ahead or behind).

In the driving embodiment of Table 1, the driving sequence for the blue pixel is −H, +L, −H and +L, while the driving sequence for the red pixel is +H, −L, +H and −L, which is different from that for the blue pixel. However, as long as the same color pixels in adjacent pixel groups are driven in the same sequence, the different color pixels in the adjacent pixel groups can be driven in different sequences.

In the driving embodiment of Table 6 (FIG. 10), the driving sequence for the blue pixel B11 of the first pixel group is: +L, −H, +L and −H, and the driving sequence for the blue pixel B12 of the second pixel group is: −H, +L, −H and +L. The driving sequences are the same but with an offset of one sub-scan period (one sub-scan period ahead or behind).

In the driving embodiment of Table 10 (FIG. 14), the driving sequence for the blue pixel B11 of the first pixel group is: +L, −H, +L and −H, and the driving sequence for the blue pixel B12 of the second pixel group is: −H, +L, −H and +L. The driving sequences are the same but with an offset of one sub-scan period (one sub-scan period ahead or behind).

C. Driving Sequence +H, +L, −H and −L

The sequence +H, +L, −H, −L are driven in two consecutive frames (e.g., frame N and frame N+1), where each frame corresponds to a "scan period" (frame N is the first scan period, and frame N+1 is the second scan period). This driving sequence is as follows: the first sub-Gamma voltage polarity in the first sub-scan period of the first scan period is positive (+), and the display signal of the first sub-scan period of the first scan period is the bright state display signal (H) of the corresponding color pixel; the second sub-Gamma voltage polarity in the second sub-scan period of the first scan period is positive (+), and the display signal in the second sub-scan period of the first scan period is the dark state display signal (L) of the corresponding color pixel; the first sub-Gamma voltage polarity in the first sub-scan period of the second scan period is negative (−), and the display signal in the first sub-scan period of the second scan period is the bright state display signal (H) of the corresponding color pixel; the second sub-Gamma voltage polarity in the second sub-scan period of the second scan period is negative (−), and the display signal in the second sub-scan period of the second scan period is the dark state display signal (L) of the corresponding color pixel.

Unlike the previous two driving sequences, this driving sequence repeats every two frames (rather than every frame).

In the driving embodiment of Table 3, depicted in FIG. 7, the driving sequence for the red pixel R11 of the first pixel group is: +H, +L, −H and −L, and the driving sequence for the red pixel R12 of the second pixel group is: −H, −L, +H and +L. The driving sequences for the two adjacent red pixels R11 and R12 are the same but with an offset of two sub-scan periods (two sub-scan periods ahead or behind). Moreover, the driving sequences for the adjacent red pixels R21 and R22 are also the same, as follows for frames N, N+1, N+2, N+3, etc.:

R11: <u>+H,+L,−H,−L</u>, +H, +L, −H, −L, . . .

R12: −H, −L, <u>+H,+L,−H,−L</u>, +H, +L, . . .

R21: −H, −L, <u>+H,+L,−H,−L</u>, +H, +L, . . .

R22: <u>+H,+L,−H,−L</u>, +H, +L, −H, −L, . . .

The underlined sequences are identical.

In the driving embodiment of Table 3, the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods. The driving sequences for the adjacent green pixels G21 and G22 are also the same.

In the driving embodiment of Table 3, the driving sequence for the blue pixel B11 of the first pixel group is: +H, +L, −H and −L, and the driving sequence for the blue pixel B12 of the second pixel group is: −H, −L, +H and +L. The driving sequences are the same but with an offset of two sub-scan periods. The driving sequences for the adjacent blue pixels B21 and B22 are also the same.

In the driving embodiment of Table 4 (FIG. 8), the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods.

In the driving embodiment of 8 (depicted in FIG. 12), the driving sequence for the red pixel R11 of the first pixel group is: +H, +L, −H and −L, and the driving sequence for the red pixel R12 of the second pixel group is: −H, −L, +H and +L. The driving sequences are the same but with an offset of two sub-scan periods.

In the driving embodiment of Table 8, the driving sequence for the green pixel G11 of the first period group is: −H, −L, +H and +L, and the driving sequence for the green pixel G12 of the second pixel group is: +H, +L, −H and −L. The driving sequences are the same but with an offset of two sub-scan periods.

In the driving embodiment of Table 8, the driving sequence for the blue pixel B11 of the first pixel group is: +H, +L, −H and −L, and the driving sequence for the blue pixel B12 of the second pixel group is: −H, −L, +H and +L. The driving sequences are the same but with an offset of two sub-scan periods.

In the driving embodiment of Table 9 (depicted in FIG. 13), the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods.

In the driving embodiment of Table 11 (FIG. 15), the driving sequence for the red pixel R11 of the first pixel group is: +H, +L, −H and −L, and the driving sequence for the red pixel R12 of the second pixel group is: −H, −L, +H and +L. The driving sequences are the same but with an offset of two sub-scan periods.

In the driving embodiment of Table 11, the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods.

In the driving embodiment of Table 11, the driving sequence for the blue pixel B11 of the first pixel group is: +H, +L, −H and −L, and the driving sequence for the blue pixel B12 of the second pixel group is: −H, −L, +H and +L. The driving sequences are the same but with an offset of two sub-scan periods.

In the driving embodiment of Table 12 (FIG. 16), the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods.

In the driving embodiment of Table 13 (FIG. 17), the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods.

In the driving embodiment of Table 14 (FIG. 18), the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods.

In the driving embodiment of Table 15 (FIG. 19), the driving sequence for the green pixel G11 of the first pixel group is: −H, −L, +H and +L, and the driving sequence for the green pixel G12 of the second pixel group is: +H, +L, −H and −L. The driving sequences are the same but with an offset of two sub-scan periods.

D. Driving Sequence +H, −L, −H and +L

The driving sequence +H, −L, −H and +L is as follows: the first sub-Gamma voltage polarity in the first sub-scan period of the first scan period is positive (+), and the display signal in the first sub-scan period of the first scan period is the bright state display signal (H) of the corresponding color pixel; the second sub-Gamma voltage polarity in the second sub-scan period of the first scan period is negative (−), and the display signal in the second sub-scan period of the first scan period is the dark state display signal (L) of the corresponding color pixel; the first sub-Gamma voltage polarity in the first sub-scan period of the second scan period is negative (−), and the display signal in the first sub-scan period of the second scan period is the bright state display signal (H) of the corresponding color pixel; the second sub-Gamma voltage polarity in the second sub-scan period of the second scan period is positive (+), and the display signal in the second sub-scan period of the second scan period is the dark state display signal (L) of the corresponding color pixel.

Again, this driving sequence repeats every two frames.

Similarly, in the driving embodiment of Table 14 (FIG. 18), the driving sequence for the blue pixel B11 of the first pixel group is: +L, +H, −L and −H, and the driving sequence for the blue pixel B12 of the second pixel group is: −L, −H, +L and +H. The driving sequences are the same but with an offset of two sub-scan periods.

The driving sequences for some color pixels according to various driving embodiments have been discussed above. The driving sequences for the red, green, and blue pixels according to the various driving embodiments are summarized in the table below:

| Driving Embodiment | Red Pixel | Green Pixel | Blue Pixel |
|---|---|---|---|
| 1 | Sequence A | Sequence B | Sequence B |
| 2 | Sequence $S_{R11} = S_{R12} = S_{R41} = S_{R42} = A$, $S_{R21} = S_{R22} = S_{R31} = S_{R32} = B$ | Sequence $S_{G11} = S_{G12} = S_{G41} = S_{G42} = A$, $S_{G21} = S_{G22} = S_{G31} = S_{G32} = B$ | Sequence $S_{B11} = S_{B12} = S_{B41} = S_{B42} = A$, $S_{B21} = S_{B22} = S_{B31} = S_{B32} = B$ |
| 3 | Sequence C | Sequence C | Sequence C |
| 4 | N/A, ($S_{R11} \neq S_{R12}$, $S_{R21} \neq S_{R22}$) | Sequence $S_{G11} = S_{G12} = S_{G31} = S_{G32} = C$, $S_{G21} = S_{G22} = S_{G41} = S_{G42} = D$ | N/A, ($S_{B11} \neq S_{B12}$, $S_{B21} \neq S_{B22}$) |
| 5 | Sequence $S_{R11} = S_{R21} = S_{R32} = S_{R42} = C$, $S_{R12} = S_{R22} = S_{R31} = S_{R41} = D$ | Sequence $S_{G12} = S_{G22} = S_{G31} = S_{G41} = C$, $S_{G11} = S_{G21} = S_{G32} = S_{G42} = D$ | Sequence $S_{B11} = S_{B21} = S_{B32} = S_{B42} = C$, $S_{B12} = S_{B22} = S_{B31} = S_{B41} = D$ |
| 6 | Sequence $S_{R11} = S_{R12} = S_{R31} = S_{R32} = A$, $S_{R21} = S_{R22} = S_{R41} = S_{R42} = B$ | N/A, ($S_{G11} \neq S_{G12}$, $S_{G21} \neq S_{G22}$) | Sequence $S_{B11} = S_{B12} = S_{B31} = S_{B32} = B$ $S_{B21} = S_{B22} = S_{B41} = S_{B42} = A$ |
| 7 | Sequence $S_{R11} = S_{R12} = S_{R21} = S_{R22} = A$, $S_{R31} = S_{R32} = S_{R41} = S_{R42} = B$ | Sequence $S_{G11} = S_{G12} = S_{G21} = S_{G22} = A$, $S_{G31} = S_{G32} = S_{G41} = S_{G42} = B$ | Sequence $S_{B11} = S_{B12} = S_{B21} = S_{B22} = A$ $S_{B31} = S_{B32} = S_{B41} = S_{B42} = B$ |
| 8 | Sequence C | Sequence C | Sequence C |
| 9 | N/A, ($S_{R11} \neq S_{R12}$, $S_{R21} \neq S_{R22}$) | Sequence $S_{G11} = S_{G12} = S_{G31} = S_{G32} = C$, $S_{G21} = S_{G22} = S_{G41} = S_{G42} = D$ | N/A, ($S_{B11} \neq S_{B12}$, $S_{B21} \neq S_{B22}$) |
| 10 | Sequence $S_{R11} = S_{R12} = S_{R41} = S_{R42} = A$, $S_{R21} = S_{R22} = S_{R31} = S_{R32} = B$ | N/A, ($S_{G11} \neq S_{G12}$, $S_{G21} \neq S_{G22}$) | Sequence $S_{B11} = S_{B12} = S_{B41} = S_{B42} = B$ $S_{B21} = S_{B22} = S_{B31} = S_{B32} = B$ |
| 11 | Sequence C | Sequence C | Sequence C |
| 12 | N/A, ($S_{R11} \neq S_{R12}$, $S_{R21} \neq S_{R22}$) | Sequence $S_{G11} = S_{G12} = S_{G31} = S_{G32} = C$ $S_{G21} = S_{G22} = S_{G41} = S_{G42} = D$ | N/A, ($S_{B11} \neq S_{B12}$, $S_{B21} \neq S_{B22}$) |
| 13 | Sequence $S_{R11} = S_{R21} = S_{R31} = S_{R41} = C$, $S_{R12} = S_{R22} = S_{R32} = S_{R42} = D$ | Sequence C | Sequence $S_{B12} = S_{B22} = S_{B32} = S_{B42} = C$, $S_{B11} = S_{B21} = S_{B31} = S_{B41} = D$ |
| 14 | Sequence C | Sequence C | Sequence D |
| 15 | Sequence C | Sequence C | Sequence D |

In the above table, driving embodiments 1-15 correspond to the driving embodiments of Tables 1-15 of FIGS. 5-19; sequence A represents sequence +H, −L, +H, −L; sequence B represents sequence −H+L, −H, +L; sequence C represents sequence +H, +L, −H, −L; and sequence D represents +H, −L, −H, +L. The indication "N/A" indicates that the driving sequences for adjacent pixels of a given color are not the same. For example, for driving embodiment 6 for the green pixel, $S_{G11} \neq S_{G12}$, $S_{G21} \neq S_{G22}$, which indicates that the sequence for G11 is not the same as the sequence for G12, and that the sequence for G21 is not the same as the sequence for G22.

The driver system for a color display according to some embodiments is thus able to match sequences of bright state display signals (H) and dark state display signals (L) at respective positive Gamma voltage (+) or the negative Gamma voltage (−) in adjacent pixel groups such that adjacent color pixels are driven by the same driving sequence (albeit offset by at least one sub-scan period). For example, with the driving sequence of +H, −L, +H and −L, it takes one frame time (+H, −L) in order to achieve the same driving sequence as the same color pixel in the adjacent pixel group. As a result, picture flickering or resolution degradation is reduced, while at the same time allow reduction of color shift due to wide viewing angles In another example, assume the driving sequence of +H, −L, −H and +L. Two frame times (+H, −L, −H and +L) are needed for driving in the same driving sequence as the same color pixel in the adjacent pixel group.

Therefore, whether the same driving sequence is achieved in one frame or two frame times, picture flickering or resolution degradation can be reduced, while achieving reduced color shift at wide viewing angles by driving pixels using bright state display signals and dark state display signals.

In the driving embodiment of Table 7 (FIG. 11), the driving sequence of the red pixel R11 of the first pixel group is: +H, −L, +H and −L, and the driving sequence of the red pixel R12 of the second pixel group is: −L, +H, −L and +H. The driving sequence of the red pixel R21 of the third pixel group is: +H, −L, +H and −L, and the driving sequence of the red pixel R22 of the fourth pixel group is: −L, +H, −L and +H. The driving sequences of the red pixels of the four adjacent pixel groups are thus the same.

Similarly, in the driving embodiment of Table 7, the driving sequence of the green pixel G11 of the first pixel group is: −L, +H, −L and +H, and the driving sequence of the green pixel G12 of the second pixel group is: +H, −L, +H and −L. The driving sequence of the green pixel G21 of the third pixel group is: −L, +H, −L and +H, and the driving sequence of the green pixel G22 of the fourth pixel group is: +H, −L, +H and −L. The driving sequences of the green pixels of the four adjacent pixel groups are thus the same.

In the driving embodiment of Table 7, the driving sequence of the blue pixel B11 of the first pixel group is: +H, −L, +H and −L, and the driving sequence of the blue pixel B12 of the second pixel group is: −L, +H, −L and +H. The driving sequence of the blue pixel B21 of the third pixel group is: +H, −L, +H and −L, and the driving sequence of the blue pixel B22 of the fourth pixel group is: −L, +H, −L and +H. The driving sequences of the blue pixel of the four adjacent pixel groups are the same.

In the driving embodiment of Table 7, the driving sequences of three color pixels (red, green and blue) in the four adjacent pixel groups are the same ($S_{R11}=S_{R12}=S_{R21}=S_{R22}=S_{G11}=S_{G12}=S_{G21}=S_{G22}=S_{B11}=S_{B12}=S_{B21}=S_{B22}$), and the best display effect is achieved. $S_{R11}$ represents the driving sequence for pixel R11; $S_{R12}$ represents the driving sequence for pixel R12; and so forth. Similarly, in the driving embodiments of Tables 3, 8, and 11, the driving sequence of three color pixels (red, green and blue) in the four adjacent pixel groups are the same ($S_{R11}=S_{R12}=S_{R21}=S_{R22}=S_{G11}=S_{G12}=S_{G21}=S_{G22}=S_{B11}=S_{B12}=S_{B21}=S_{B22}$), and the best display effect is achieved as well.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method for use with a display having plural pixel groups, each pixel group having plural color pixels, the method comprising:

during a given frame period that is divided into a first sub-period and a second sub-period, providing a first signal in the first sub-period to a first pixel of a first color in a first pixel group, and providing a second signal to the first pixel in the second sub-period, wherein the first and second signals are combined to achieve an original gray scale level for the first pixel;

setting the first signal to one of a first polarity and a second polarity, and setting the second signal to one of the first polarity and second polarity, wherein the first signal having one of the first and second polarities and the second signal having one of the first and second polarities form a first sequence;

driving a first pixel of the first color in a second pixel group that is adjacent the first pixel group with a second sequence of signals, wherein the second sequence is the same as the first sequence; and during the given frame period that is divided into the first sub-period and the second sub-period, driving a second pixel of a second, different color in the first pixel group using a third sequence of signals set during the first and second sub-periods.

2. The method of claim 1, wherein the first signal is set to the first polarity, and the second signal is set to the second polarity that is opposite the first polarity.

3. The method of claim 1, wherein the first signal is set to the first polarity, and the second signal is set to the first polarity.

4. The method of claim 1, wherein the first sequence is offset from the second sequence by a predefined time period.

5. The method of claim 1, wherein the first sequence is offset from the second sequence by one sub-period.

6. The method of claim 1, wherein the first sequence is offset from the second sequence by two sub-periods.

7. The method of claim 1, further comprising:

during a second frame period that is divided into a first sub-period and a second sub-period, providing a third signal in the first sub-period of the second frame period to the first pixel of the first pixel group, and providing a fourth signal to the first pixel of the first pixel group in the second sub-period of the second frame period, wherein the third and fourth signals are combined to achieve an original gray scale level for the first pixel of the first pixel group in the second frame period;

setting the third signal to one of the first polarity and the second polarity, and setting the fourth signal to one of the first polarity and second polarity, wherein the first signal having one of the first and second polarities, the second signal having one of the first and second polarities, the third signal having one of the first and second polarities, and the fourth signal having one of the first and second polarities form the first sequence; and wherein the second sequence is the same as the first sequence.

8. The method of claim 7, wherein the first signal comprises a bright state signal having a positive polarity, the second signal comprises a dark state signal having a negative polarity, the third signal comprises a bright state signal having a positive polarity, and the fourth signal comprises a dark state signal having a negative polarity.

9. The method of claim 7, wherein the first signal comprises a bright state signal having a negative polarity, the second signal comprises a dark state signal having a positive polarity, the third signal comprises a bright state signal having a negative polarity, and the fourth signal comprises a dark state signal having a positive polarity.

10. The method of claim 7, wherein the first signal comprises a bright state signal having a positive polarity, the second signal comprises a dark state signal having a positive polarity, the third signal comprises a bright state signal having a negative polarity, and the fourth signal comprises a dark state signal having a negative polarity.

11. The method of claim 7, wherein the first signal comprises a bright state signal having a positive polarity, the second signal comprises a dark state signal having a negative polarity, the third signal comprises a bright state signal having a negative polarity, and the fourth signal comprises a dark state signal having a positive polarity.

12. The method of claim 1, wherein setting the first signal to one of the first polarity and second polarity comprises setting the first signal to one of a positive Gamma polarity and a negative Gamma polarity, and wherein setting the second signal to one of the first polarity and second polarity comprises setting the second signal to one of a positive Gamma polarity and a negative Gamma polarity.

13. The method of claim 1, wherein the first and second signals are combined based on user perception of the pixel of the given color.

14. The method of claim 1, further comprising:

driving a second pixel of the second color in the second pixel group using the third sequence that is the same as the first and second sequences; and driving third pixels of a third color in the first and second pixel groups using a fourth sequence of signals, wherein the fourth sequence is the same as the first and second sequences.

15. A driver system for use with a display having plural pixel groups, each pixel group having plural color pixels, the driver system comprising:

a display signal controller to:

during a given frame period that is divided into a first sub-period and a second sub-period, provide a first signal in the first sub-period to a first pixel of a first color in a first pixel group, and provide a second signal to the first pixel in the second sub-period, wherein the first and second signals are for combination to achieve an original gray scale level for the first pixel; and a polarity controller to set the first signal to one of a first polarity and a second polarity, and set the second signal to one of the first polarity and second polarity, wherein the first signal having one of the first and second polarities and the second signal having one of the first and second polarities form a first sequence, wherein the display signal controller and polarity controller cooperate to further:

drive a first pixel of the first color in a second pixel group that is adjacent the first pixel group with a second sequence of signals, wherein the second sequence is the same as the first sequence, and during the given frame period that is divided into the first sub-period and the second sub-period, drive a second pixel of a second, different color in the first pixel group using a third sequence of signals set during the first and second sub-periods.

16. The driver system of claim 15, wherein the first signal is a bright state signal set to a positive Gamma polarity, and the second signal is a dark state signal set to a negative Gamma polarity.

17. The driver system of claim 15, wherein the first signal is a bright state signal set to a negative Gamma polarity, and the second signal is a dark state signal set to a positive Gamma polarity.

18. The driver system of claim 15, wherein the first signal is a bright state signal set to a positive Gamma polarity, and the second signal is a dark state signal set to a positive Gamma polarity.

19. The driver system of claim 15, wherein the first sequence is offset from the second sequence by one sub-period.

20. The driver system of claim 15, wherein the first sequence is offset from the second sequence by two sub-periods.

21. The driver system of claim 15, wherein the display signal controller is adapted to further:

during a second frame period that is divided into a first sub-period and a second sub-period, provide a third signal in the first sub-period of the second frame period to the first pixel of the first pixel group, and provide a fourth signal to the first pixel of the first pixel group in the second sub-period of the second frame period, wherein the third and fourth signals are for combination to achieve a target original gray scale level for the first pixel of the first pixel group in the second frame period; and wherein the polarity controller is adapted to set the third signal to one of the first polarity and the second polarity, and set the fourth signal to one of the first polarity and second polarity, wherein the first signal having one of the first and second polarities, the second signal having one of the first and second polarities, the third signal having one of the first and second polarities, and the fourth signal having one of the first and second polarities form the first sequence; and wherein the second sequence is the same as the first sequence.

22. The driver system of claim 21, wherein the first signal comprises a bright state signal having a positive polarity, the second signal comprises a dark state signal having a negative polarity, the third signal comprises a bright state signal having a positive polarity, and the fourth signal comprises a dark state signal having a negative polarity.

23. The driver system of claim 21, wherein the first signal comprises a bright state signal having a negative polarity, the second signal comprises a dark state signal having a positive polarity, the third signal comprises a bright state signal having a negative polarity, and the fourth signal comprises a dark state signal having a positive polarity.

24. The driver system of claim 21, wherein the first signal comprises a bright state signal having a positive polarity, the second signal comprises a dark state signal having a positive polarity, the third signal comprises a bright state signal having a negative polarity, and the fourth signal comprises a dark state signal having a negative polarity.

25. The driver system of claim 21, wherein the first signal comprises a bright state signal having a positive polarity, the second signal comprises a dark state signal having a negative polarity, the third signal comprises a bright state signal having a negative polarity, and the fourth signal comprises a dark state signal having a positive polarity.

26. The driver system of claim 15, wherein the third sequence is the same as the first sequence and second sequence, and wherein the display signal controller and polarity controller cooperate to further:

drive a third pixel of a third color in the first pixel group using a fourth sequence of signals, wherein the fourth sequence is the same as the first sequence;

drive a second pixel of the second color in the second pixel group using the third sequence; and drive a third pixel of the third color in the second pixel group using the fourth sequence.

27. The driver system of claim 15, wherein the third sequence is different from the first sequence.

28. A display device comprising:

a color display panel having plural pixel groups, each pixel group having plural color pixels; and a driver system coupled to the color display panel, the driver system comprising:

a display signal controller to:

during a first frame period that is divided into plural sub-periods, provide plural display signals in the respective sub-periods to a first pixel of a first color in a first pixel group, wherein the plural display signals are for combination to achieve an original gray scale level for the first pixel; and a polarity controller to set respective polarities of the display signals, wherein the plural display signals having respective polarities form a first sequence, wherein the display signal controller and polarity controller cooperate to further:

drive a first pixel of the first color in a second pixel group that is adjacent the first pixel group with a second sequence of signals, wherein the second sequence is the same as the first sequence, and drive a second pixel of a second, different color in the first pixel group using a third sequence of display signals set during the same respective sub-periods during which the display signals for the first pixel of the first pixel group are set.

29. The display device of claim 28, wherein the plural display signals for the first pixel of the first pixel group driven in the respective sub-periods comprise a bright state display signal and a dark state display signal.

30. The display device of claim 29, the display signal controller to:

during a second frame period that is divided into plural sub-periods, provide additional plural display signals to the first pixel in the first pixel group, wherein the polarity controller is configured to set respective polarities of the additional display signals, wherein the display signals in the sub-periods of the first frame period and display signals in the sub-periods of the second frame period form the first sequence, and wherein the first pixel of the first color in the second pixel group is driven with the second sequence that is the same as the first sequence.

31. The display device of claim 30, wherein the first sequence and second sequence are offset by one sub-period.

32. The display device of claim 30, wherein the first sequence and second sequence are offset by two sub-periods.

* * * * *